US006728502B2

(12) United States Patent
Hara

(10) Patent No.: US 6,728,502 B2
(45) Date of Patent: Apr. 27, 2004

(54) ELECTROCONDUCTIVE MEMBER AND IMAGE FORMING APPARATUS USING THE SAME

(75) Inventor: Yukio Hara, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/281,109

(22) Filed: Oct. 28, 2002

(65) Prior Publication Data

US 2003/0175045 A1 Sep. 18, 2003

(30) Foreign Application Priority Data

Mar. 15, 2002 (JP) ..... 2002-071820

(51) Int. Cl.[7] ..... G03G 15/02
(52) U.S. Cl. ..... 399/176; 399/302; 399/303
(58) Field of Search ..... 399/168, 176, 399/297, 302, 303, 308; 492/53, 56; 430/31

(56) References Cited

FOREIGN PATENT DOCUMENTS

| | | | |
|---|---|---|---|
| JP | A 63-83764 | | 4/1988 |
| JP | A 2-264277 | | 10/1990 |
| JP | A 7-271204 | | 10/1995 |
| JP | A 8-185068 | | 7/1996 |
| JP | A 8-292648 | | 11/1996 |
| JP | A 9-179414 | | 7/1997 |
| JP | 2001-2896 | * | 1/2001 |

* cited by examiner

*Primary Examiner*—Hoan Tran
(74) *Attorney, Agent, or Firm*—Oliff & Berridge PLC

(57) ABSTRACT

An electroconductive member contains an electroconductive composition using a thermoplastic elastomer material having advantages such as reduction in energy of production process thereof and capability of being recycled, and which makes it possible to prevent a change in resistance by sending an electric current, improve uniformity of electric resistance, and reduce dependency on an electric field and a resistance-change by environment. The electroconductive resin composition contains an epoxidized diene block copolymer; a thermoplastic elastomer other than the epoxidized diene block copolymer, a conductive agent and one of a thermoplastic resin and a compound having an amino group.

23 Claims, 5 Drawing Sheets

RELATIONSHIP BETWEEN SHAPE (HEIGHT AND WIDTH) OF PROJECTIONS OF SURFACE OF BELT AND IMAGE QUALITY DEFECTS

ELECTROCONDUCTIVE MEMBER AND IMAGE FORMING APPARATUS USING THE SAME

BACKGROUND OF THE INVENTION

1. Field of the Invention

The present invention relates to an electroconductive member used in an electrophotographic copying machine, printer or the like, and an image forming apparatus using the same.

2. Description of Related Art

In an image forming apparatus using an electrophotographic manner, uniform electric charges are formed (electrification) on the surface of an electrostatic latent image carrier (photoreceptor), and an electrostatic latent image is formed using a laser with modulated image signals. Thereafter, the electrostatic latent image is developed with electrified toner to form a toner image. The toner image is electrostatically transferred, through an intermediate transfer member or directly, onto a recording medium, whereby a desired transferred image can be obtained.

In the transferring manner using the intermediate transfer member, a semiconductive endless belt (semiconductive belt) is adopted as the intermediate transfer member. This semiconductive belt is generally made of an elastic material from the viewpoint of easy control of the driving of the belt, and the other viewpoints. In general, a vulcanized rubber as follows is used: ethylene-propylene-diene rubber (EPDM), urethane rubber, epichlorohydrin rubber.

For example, Japanese Published Unexamined Patent Application No. Hei 2-264277 suggests the use of a belt wherein a polyethylene film is laminated on an EPDM rubber having a volume resistivity of $10^{15}$ to $10^{16}$ Ωcm. Furthermore, Japanese Published Unexamined Patent Application No. Sho 63-83764 suggests a semiconductive belt or the like wherein an elastic body is used as a material having a volume resistivity of about $10^{10}$ to $10^{13}$ Ωcm.

Since the semiconductive belt is made of an elastic body having high elasticity, the belt has a higher tensile strength than elastomers. The transferring semiconductive belt for forming an image is required to have given paper-passing durability as well as a high tensile strength. About this paper-passing durability, a good performance is obtained by setting the thickness of the belt to a given thickness.

In the case in which the following is used in order to obtain such a high tensile strength and given paper-passing durability: for example, the transferring carrying belt described in the Japanese Published Unexamined Patent Application No. Hei 2-264277, having a volume resistivity of $10^{15}$ to $10^{16}$ Ωcm, or the transferring carrying belt described in the Japanese Published Unexamined Patent Application No. Sho 63-83764, having a volume resistivity of about $10^{10}$ to $10^{13}$ Ωcm, there arises a problem that an electric field necessary for the transfer becomes large so that a heavy burden is imposed on a power source for applying voltage to the belt.

Since the transferring carrying belt holds a transferring material (recording medium) through electrostatic absorption power, discharge of electricity may be generated when the transferring material is separated from the belt. In this case, a transfer image on the surface of the transferring material may be disturbed. This discharge is easily generated particularly under environment of a low temperature and low humidity. However, in the case in which the abovementioned semiconductive belt having a high volume resistivity is used as the transferring carrying belt, a high voltage is necessary for holding the transferring material by means of the belt; therefore, discharge of electricity is easily generated. This discharge phenomenon causes some parts of toner on the surface of the transferring material to reverse polarity. Thus, transfer defects are generated so that image defects called voids (white omissions, or drop-outs) are caused in some parts of the transferring material surface. Thus, the transfer image is easily disturbed to result in a problem that a good image quality is not easily obtained.

In the case in which the volume resistivity of the transferring carrying belt is less than $10^2$ Ωcm, electric charges flow easily, thereby resulting in a problem that the transferring material cannot be held through electrostatic absorption power.

Japanese Published Unexamined Patent Application No. Hei 8-185068 suggests, as a transferring carrying belt, a belt wherein the surface of an elastic body having a volume resistivity of $10^9$ Ωcm or less, such as chloroprene, is coated with a nylon resin or an urethane resin. In the case in which the surface layer of the chloroprene is coated with the nylon resin, the surface coat layer cannot follow deformation of the transferring carrying belt at a curvature portion, where the belt passes through a roll-shaped support, since the coat layer is hard. Thus, a crack may be generated in the surface layer. In the case of the urethane resin coat, the coat layer has flexibility not to cause a problem of the generation of a crack on the coat layer surface as described above. However, this belt has a problem that toner adheres easily to the surface so that the surface easily gets dirty.

In the case in which an elastic body such as chloroprene in which carbon black or the like is dispersed is used for the transferring carrying belt, a desired stable resistance value can hardly be obtained even if ordinary conductive carbon black is added to ordinary rubber material. This is because a semiconductive resistance range having a resistivity of about $10^9$ Ωcm is a range wherein resistivity is not easily controlled. As a result, it is difficult that variation in the resistance of the belt using the abovementioned elastic body is stably set in such a manner that the common logarithm of the volume resistance thereof is within one figure (digit). In the case in which in-plane variation in the resistance is one figure or more, transferring voltage cannot be uniformly applied. Therefore, a problem arises that image quality after transfer is not stable.

In order that the semiconductive belt holds the transferring material and a toner image is transferred onto the transferring material, a transferring voltage of 1 to 5 kV is applied. This applied voltage causes a change in the resistance of the belt material, resulting in a problem that a difference in the resistance value of the belt is generated between the region where the transferring material is present and the region where it is not present.

To overcome a change over time in the resistance value of the abovementioned belt material and unevenness of the belt resistance value, Japanese Published Unexamined Patent Application No. Hei 8-292648 suggests a transferring carrying belt formed of three layers wherein the volume resistivity of the first layer (surface layer) is set within the range of $1\times10^{10}$ to $1\times10^{16}$ Ωcm; a rubber layer using the conductivity of a polymer itself, the volume resistivity range thereof being from $1\times10^7$ to $1\times10^{10}$ Ωcm, is used as the second layer (intermediate layer); and the volume resistivity of the third layer (base layer) is set within the range of $1\times10^{10}$ to $1\times10^{16}$ Ωcm. This publication states that the unevenness of the resistance value can be improved by the rubber layer using the conductivity of the polymer itself, which is the second layer (intermediate layer). However, in the case of the laminated belt, the resistance value thereof is controlled by the layer having a high resistance value. Thus, the unevenness of the resistance value is not sufficiently overcome.

Japanese Published Unexamined Patent Application No. Hei 9-179414 suggests a rubber material made of chloroprene rubber and EPDM (ethylene propylene diene monomer) as a countermeasure against the change over time in the resistance of the belt material. However, this suggestion is insufficient for overcoming this change over time and the unevenness of the belt resistance.

Furthermore, Japanese Published Unexamined Patent Application No. 7-271204 suggests the use of an ion-conductive type rubber material made of a rubber material having an intense polarity, such as hydrin rubber, as a countermeasure against the change over time in the resistance value of the belt material and the unevenness of the belt resistance value. In the case of using an electroconductive type rubber material using a conductive agent such as carbon black, a problem of a change in the resistance value does not arise between a high temperature with high humidity and a low temperature and low humidity. However, the ion-conductive type rubber material has a problem that the resistance value thereof changes by 1.5 figure or more between a high temperature and high humidity and a low temperature and low humidity.

In the abovementioned image forming apparatus using electrophotography, a contact charging manner using a charging member is adopted as the abovementioned charging processing manner. An charging roll is the most popular member as the charging member. It is known that the mechanism of electrification onto the surface of a photoreceptor (electrostatic latent image carrier) by means of this charging roll is based on electric discharge according to Paschen's law in minute spaces between the charging roll and the photoreceptor. Since the contact type charging roll contacts the photoreceptor made of a metal substrate at a given pressing force and contact-rotates with rotation of the photoreceptor, a floating space is generated at a small hollow in the roll surface between the roll and the photoreceptor in the case in which the charging roll does not have sufficient flexibility. Thus, the abovementioned minute spaces are scattered so that electrification poorness is generated.

Therefore, in the charging roll, the generation of the floating space is prevented by depositing a conductive elastic layer on the surface of the conductive support (substrate). For this conductive elastic layer, a vulcanized rubber material as follows is generally used: the abovementioned ethylene-propylene-diene rubber (EPDM), urethane rubber, silicone rubber, or epichlorohydrin rubber.

In the conductive elastic layer of the charging roll, carbon black or the like is used as a conductive agent as described above. Therefore, if the resistance value thereof is set within a semiconductive range, variation in the resistance value becomes large, causing a problem that image defects such as electrification poorness are partially generated.

Incidentally, worldwide environment protection activities have been highlighted in recent years. For enterprises, activities in which importance is attached to environment, such as a cutback in energy consumption in a production process and a cutback in waste, have been demanded.

However, about the rubber materials to be vulcanized and used in the abovementioned belt or roll, energy is consumed in a vulcanizing step in the production thereof. Furthermore, once the material is vulcanized, recycle based on re-shaping thereof is impossible. Therefore, from the viewpoint of environment protection, these materials are very unfavorable.

Thus, it is considered that a thermoplastic elastomer material is used as the material of the belt or the roll instead of the vulcanized material. Since the thermoplastic elastomer can be shaped in the same way as in the case of thermoplastic resins, the elastomer has advantages for environment protection, such as omission of the vulcanizing step and adaptability for recycle. The thermoplastic elastomer can be worked more speedily with a shaping machine for thermoplastic resins than crosslinking elastomer. The thermoplastic elastomer requires only a short shaping cycle and requires no vulcanizing step. That is, the thermoplastic elastomer is an energy-saving, labor-saving and time-saving material and can realize a simple production process. Moreover, scraps thereof can easily be recycled since products from the elastomer have not been crosslinked.

However, in the case in which this thermoplastic elastomer is used for a semiconductive belt or the like, deformation is easily generated on the basis of the intrinsic stress strain of the material, as described above. Particularly in the case of a belt, the belt follows the curvature of a supporting roll on which the belt is stretched so as to deform easily when the running of the belt is stopped for a long time. Thus, it may be impossible that the belt adsorbs a transferring material electrostatically and carries the material stably. Furthermore, in the case in which an electroconductive agent such as carbon black is used, if the resistance value is set within a semiconductive range (about $10^6$ to $10^{12}$ Ωm), variation in the resistance value is large. Thus, image defects such as partial transfer poorness are generated. The image defects are caused by the fact that the electroconductive agent is not easily dispersed uniformly in the thermoplastic elastomer to generate poor dispersion.

In the case in which such a material is used for a charging member whose resistance value is set within the semiconductive range, image defects such as partial electrification poorness are generated. When the conductive agent (carbon black) is dispersed as it is into a thermoplastic elastomer, the hardness of the conductive elastic layer itself rises, causing problems that electrification poorness is generated by poor contact thereof with a photoreceptor.

As a semiconductive thermoplastic elastomer, an elastomer in which carbon black is not dispersed but an ion conductive agent is dispersed is known. In this type of thermoplastic elastomer, variation in resistance value is smaller in the same manner as in the case of the crosslinking rubber than in the elastomer in which carbon black is dispersed. However, when the thermoplastic elastomer in which the ion conductive agent is dispersed is used, the following problems may be generated: the dependency of the resistance upon environment and a change in the resistance by continuous sending of an electric current are generated; and this ion conductive agent bleeds to contaminate the surface of a photoreceptor surface. This phenomenon is remarkable when the blend amount of the ion conductive agent is made large.

As a unit that solves these problems, it is considered that a protective layer having a barrier function is deposited on the surface of the conductive elastic layer. However, this protective layer is required to be thin and homogenous and have a good surface property in order not to damage the function of the transferring carrying belt. In a charging roll or the like on which such a protective layer is formed by such a unit, an ion conductive agent also bleeds from its semiconductive elastomer layer to the surface of the protective layer so that the surface of a photosensitive roll may be contaminated.

SUMMARY OF THE INVENTION

In view of the abovementioned circumstances, the present invention provides an electroconductive member which includes an electroconductive composition using a thermoplastic elastomer material having advantages such as reduction in energy of a production process thereof and capability of being recycled, and which makes it possible to prevent a change in resistance by sending an electric current, improve uniformity of electric resistance, and reduce the dependency on an electric field and a resistance-change by environment. The present invention also provides an image forming apparatus using the abovementioned electroconductive member.

An aspect of the present invention provides an electroconductive member including an electroconductive resin composition having an epoxidized diene block copolymer, a thermoplastic elastomer other than the epoxidized diene block copolymer or a thermoplastic resin and a conductive agent.

Another aspect of the present invention provides an electroconductive member, wherein the electroconductive resin composition includes the epoxidized diene block copolymer, the thermoplastic elastomer other than the epoxidized diene block copolymer, and the conductive agent, the member being a semiconductive belt including the electroconductive resin composition.

Another aspect of the present invention provides an electroconductive member, wherein the electroconductive resin composition includes the epoxidized diene block copolymer, the thermoplastic elastomer other than the epoxidized diene block copolymer, and the conductive agent, the member being an electroconductive roll, wherein an electroconductive elastic layer containing the electroconductive resin composition is formed on a surface of a substrate.

Another aspect of the present invention provides an image forming apparatus wherein the electroconductive member is the abovementioned semiconductive belt and used as a transfer material carrying belt.

Another aspect of the present invention provides an image forming apparatus wherein the electroconductive member is the abovementioned semiconductive belt and used as an intermediate transfer member.

Another aspect of the present invention provides an image forming apparatus wherein the electroconductive member is the abovementioned electroconductive roll and used as a charging unit.

Another aspect of the present invention provides an image forming apparatus wherein the electroconductive member is the abovementioned electroconductive roll and used as an intermediate transfer member.

BRIEF DESCRIPTION OF THE DRAWINGS

Preferred embodiments of the present invention will be described in detail based on the following, wherein.

DESCRIPTION OF THE PREFERRED EMBODIMENTS

Figure 1A:
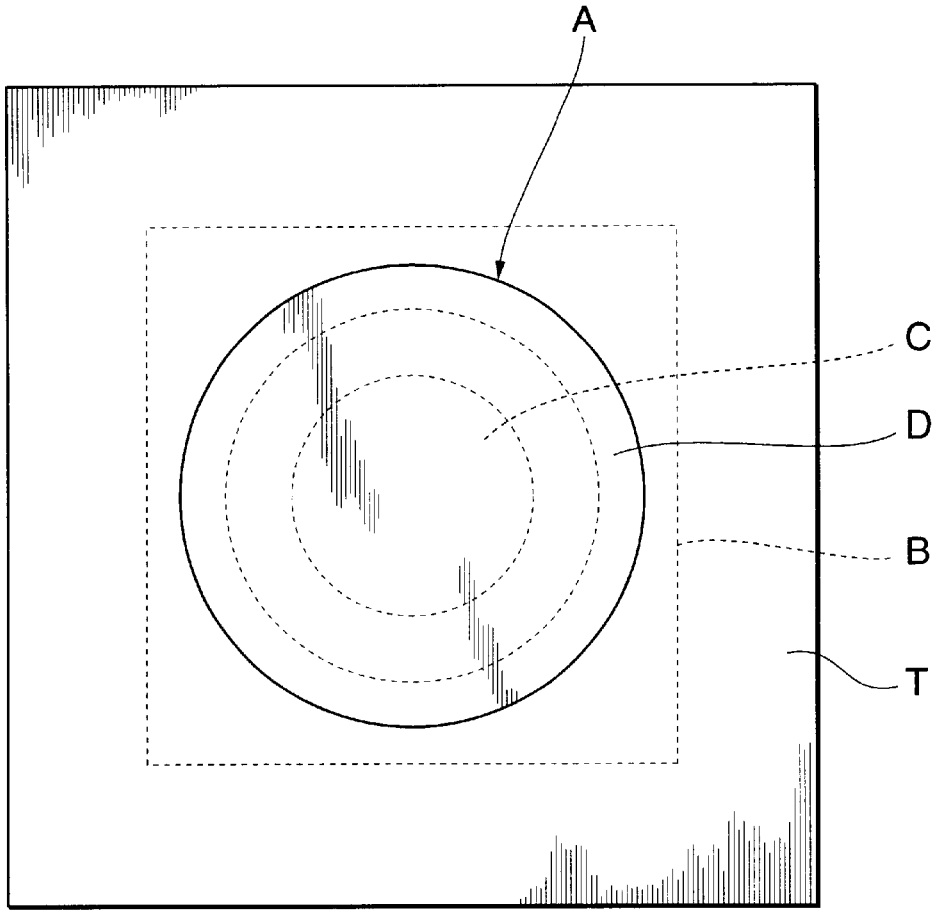
FIG. 1A is a schematic plan view illustrating one example of a circular electrode for measuring surface resistivity and volume resistivity.

The present invention will be described in detail hereinafter.

Electroconductive Member

The electroconductive member of the present invention includes an electroconductive resin composition having an epoxidized diene block copolymer, a thermoplastic elastomer other than the epoxidized diene block copolymer or a thermoplastic resin and a compound having an amino group, and a conductive agent. A semiconductive elastic layer constituting the semiconductive belt of the present invention or an electroconductive elastic layer constituting the electroconductive roll of the present invention is made of this electroconductive composition. The electroconductive member of the present invention is not limited to the semiconductive belt or the electroconductive roll, and can widely be used as an electroconductive member used in a charging device, a developing device, a transferring device or the like in an electrophotographic image forming apparatus.

Electroconductive Resin Composition

The electroconductive resin composition used in the present invention includes an epoxidized diene block copolymer, a thermoplastic elastomer other than the epoxidized diene block copolymer or a thermoplastic resin and a compound having an amino group, and a conductive agent.

Epoxidized Diene Block Copolymer

The epoxidized diene block copolymer used in the present invention is made from a diene block copolymer. This diene block copolymer means a polymer block made mainly of a vinyl aromatic compound or a block copolymer including a polymer block made mainly of a conjugated diene compound. The ratio of the mass (A) of the vinyl aromatic compound to the mass (B) of the conjugated diene compound in the block copolymer (the mass ratio in the block copolymer: A/B) is preferably from 5/95 to 90/10, more preferably from 10/90 to 80/20.

About the molecular weight of the diene block copolymer, the number-average molecular weight thereof is preferably from 5,000 to 1,500,000, more preferably from 10,000 to 800,000. The molecular weight distribution [the ratio of the weight-average molecular weight (Mw) to the number-average molecular weight (Mn) (Mw/Mn)] is preferably 10 or less.

The molecular structure of the diene block copolymer may be in a linear, branched or radical form, or in any combination form thereof. When the polymer block made mainly of the vinyl aromatic compound and the polymer block made mainly of the conjugated diene compound are represented by X and Y, respectively, the molecular structure has, for example, X—Y—X, Y—X—Y—X, $(X—Y)_4Si$, or X—Y—X—Y—X. The unsaturated bonds in the conjugated diene compound of the diene block copolymer may be partially-hydrogenated bonds.

Examples of the vinyl aromatic compound constituting the diene block copolymer include styrene, α-methylstyrene, vinyltoluene, p-tertiarybutylstyrene, divinylbenzene, p-methylstyrene, and 1,1-diphenylstyrene.

One or more selected from these compounds may be used. Styrene is preferable.

Examples of the conjugated diene compound constituting the diene block copolymer include butadiene, isoprene, 1,3-pentadiene, 2,3-dimethyl-1,3-butadiene, piperylene, 3-butyl-1,3-octadiene, and phenyl-1,3-butadiene. One or more selected from these compounds may be used. Butadiene, isoprene and a combination thereof are preferable.

The process for producing the diene block copolymer may be any process making it possible to produce the copolymer having the abovementioned structure. For example, using a lithium catalyst or the like, a vinyl aromatic compound/conjugated diene compound block copolymer can be synthesized in an inactive solvent.

Furthermore, a partially-hydrogenated block copolymer used in the present invention can be synthesized by hydrogenating the abovementioned block copolymer in an inactive solvent in the presence of a hydrogenating catalyst.

Next, the diene block copolymer is partially epoxidized as described above, thereby yielding the epoxidized diene block copolymer used in the present invention.

The epoxidized diene block copolymer used in the present invention can be obtained by reacting the abovementioned diene block copolymer with an epoxidizing agent such as an agent selected from hydroperoxides and peracids in an inactive solvent. Examples of the peracid include formic peracid, acetic peracid, and benzoic peracid. In the case in which the abovementioned hydroperoxide is used, a catalytic effect can be obtained by use of hydroperoxide and a mixture of tungstic acid and sodium hydroxide, hydroperoxide and an organic acid, or t-butyl hydroperoxide and molybdenum hexacarbonyl together. The addition amount of the epoxidizing agent is not strictly limited. The optimal amount in each case depends on variable factors such as the particular used epoxidizing agent, a desired epoxidization degree, and the particular used block copolymer.

The epoxidized diene block copolymer obtained by the abovementioned reaction can be isolated by a suitable method, for example, a method of precipitating the copolymer in a poor-solvent, a method of putting the solution of the polymer in hot water with stirring and then distilling off the solvent, or a direct solvent-removing method.

In the resultant epoxidized diene block copolymer, the polymer block made mainly of the conjugated diene compound constituting the diene block copolymer and the polymer block made mainly of the hydrogenated conjugated diene compound partially includes epoxy groups. The epoxy equivalent in the epoxidized diene block copolymer is preferably from 200 to 10,000. Specific examples of the epoxidized diene block copolymer include Epofriend A1020, Epofriend A1010, and Epofriend A1005, made by DAICEL CHEMICAL INDUSTRIES, LTD., wherein the molecules of butadienes in styrene-butadiene block copolymer partially have epoxy groups.

As described above, the epoxy groups are introduced to the epoxidized diene block copolymer, so that polarity and reactivity thereof are given to the copolymer. Therefore, the copolymer have superior compatibility with various resins, and can further contribute to an improvement in dispersibility of the conductive agent such as carbon black, which will be described in detail later. Since a polar group is introduced to the main chain of the copolymer, the copolymer has small hygroscopic property. Thus, the copolymer can suppress the generation of bubbles from a semiconductive belt including the electroconductive composition mixed with acidic carbon black, which will be described later. Furthermore, copolymer can improve the impact strength and heat resistance of other thermoplastic resins to be mixed by high reactivity of the epoxy groups, and can suppress a change over time in the impact strength and so on.

The blend amount of the epoxidized diene block copolymer blended in the electroconductive composition used in the present invention is preferably from 1 to 30 parts by mass, more preferably from 3 to 25 parts by mass, and still more preferably form 5 to 20 parts by mass per 100 parts by mass of the thermoplastic elastomer.

If the blend amount of the epoxidized diene block copolymer is less than 1 part by mass, an effect of improving compressed strain quantity, based on the addition of the epoxidized diene block copolymer in the resultant elastic body, may be small. If the blend amount is more than 30 parts by mass, the flexibility of the resultant elastic body may be insufficient.

The blend amount of the epoxidized diene block copolymer is preferably from 1 to 50 parts by mass, more preferably from 3 to 40 parts by mass, and still more preferably from 5 to 30 parts by mass per 100 parts of the thermoplastic resin.

If the blend amount of the epoxidized diene block copolymer is less than 1 part by mass, an effect of improving the toughness of the resin material by adding the epoxidized diene block copolymer may be small. If the blend amount is more than 50 parts by mass, the semiconductive belt becomes soft so that the mechanical strength required for the belt, for example, a Yong's modulus of 10000 kg/cm$^2$ or more may not be satisfied.

Thermoplastic Elastomer other than the Epoxidized Diene Block Copolymer

The thermoplastic elastomer used in the case in which the electroconductive member of the present invention is a semiconductive belt is not particularly limited if the elastomer is any thermoplastic elastomer other than the epoxidized diene block copolymer. Examples thereof include styrene-based thermoplastic elastomer, polyolefinic thermoplastic elastomer, polyester-type thermoplastic elastomer and polyamide-type thermoplastic elastomer. Among these elastomers, the polyester-type thermoplastic elastomer and the polyamide-type thermoplastic elastomer are preferably used from the viewpoint of high hardness and so on.

Preferred examples of the polyester-type thermoplastic elastomer include "DIAALLOY R" made by MITSUBISHI RAYON CO., LTD., "Pelprene" made by TOYOBO CO., LTD., "Hytrl" made by Du Pont, "GRILUX" made by AKZO, "Lomod" made by GE, "Ecdel" made by Eastman, "Ritrflex" made by Hoechst-Celanese, and "Pibiflex" made by Enimont.

The abovementioned polyamide-type thermoplastic elastomer is a thermoplastic elastomer formed of polyamide segments and polyether segments, and preferred examples thereof include "UBE-PAE" made by Ube Industries. Ltd, "DIAMID-PAE" made by DAICELHULS LTD., "Pebax" made by Atochemi, "GRILON" and "Grilamid" made by EMS (EMS Japan), "GRILUX A" made by EMS (DAINIPPON INK & CHEMICALS, INC), "Novamid EL" made by MITSUBISHI CHEMICAL CORPORATION, and "Estmaid" made by Dow Chemical.

Examples of the thermoplastic elastomer used in the case in which the electroconductive member of the present invention is an electroconductive roll include styrene-based thermoplastic elastomer, polyolefinic thermoplastic elastomer, polyester-type thermoplastic elastomer and polyamide-type thermoplastic elastomer. Among these elastomers, the styrene-based thermoplastic elastomer and the polyolefinic are preferably used from the viewpoint of low hardness and so on.

Examples of the styrene-based thermoplastic elastomer include a hydrogenated product of styrene-butadiene block copolymer, a hydrogenated product of styrene-isoprene block copolymer, a product made basically of a hydrogenated product of styrene-conjugated diene block copolymer selected from mixture thereof. Examples of the hydrogenated product of the styrene-conjugated diene block copolymer include copolymers having a polymer block wherein the conjugated diene thereof is butadiene alone, isoprene alone, or a mixture of isoprene and butadiene, specifically a hydrogenated product of styrene-butadiene-styrene block copolymer, which may be abbreviated merely to "hydrogenated S—B—S" hereinafter, a hydrogenated product of styrene-isoprene-styrene block copolymer, which may be abbreviated merely to "hydrogenated S—I—S" hereinafter, and a hydrogenated product of styrene-isoprene-butadiene-styrene block copolymer, which may be abbreviated merely to "hydrogenated S—BI—S" hereinafter.

About the molecular weight of these hydrogenated products of the styrene-conjugated diene block copolymers, the weight-average molecular weight thereof is preferably from 50,000 to 500,000, more preferably from 120,000 to 450,000, and still more preferably from 150,000 to 400,000.

If the weight-average molecular weight of the hydrogenated product of the styrene-conjugated diene block copolymer is less than 50,000, rubber elasticity and mechanical strength may be poor. If it is more than 500,000, formability may tend to be poor.

The styrene content in the abovementioned copolymer is preferably from 5 to 50% by mass, more preferably from 8 to 45% by mass, and still more preferably from 10 to 40% by mass.

The hydrogenated S—I—S and hydrogenated S—BI—S can be obtained by preparing styrene and isoprene, or styrene, isoprene and butadiene; adding, thereto, 0.01 to 0.2 part by mass of an alkyllithium compound as an initiator and 0.04 to 0.8 part by mass of a coupling agent to 100 parts of all the monomers; polymerizing the monomers successively in an inactive solvent in the presence of 0.1 to 400 parts by mass of a Lewis base per 100 parts of the initiator at −20 to 80° C. for 1 to 50 hours; and hydrogenating the isoprene polymer blocks and the isoprene-butadiene copolymer blocks. Preferred examples of commercially available products thereof include "KRATON G" made by Shell Chemicals Japan Ltd., "SEPTON" and "HYBRAR" made by KURARAY CO., LTD., "Tuftec" made by ASAHI CHEMICAL INDUSTRY CO., LTD., and "DYNARON" made by Japan Synthetic Rubber Company.

Examples of the styrene-based thermoplastic elastomer which basically contains the hydrogenated product of the styrene-conjugated diene block copolymer include "RABALON" made by MITSUBISHI CHEMICAL CORPORATION, "KRATON G Compound" made by Shell Chemicals Japan Ltd., "SEPTON Compound" made by KURARAY CO., LTD., and "Tuftec Compound E series and S series" made by ASAHI CHEMICAL INDUSTRY CO., LTD.

Examples of the olefinic thermoplastic elastomer used in the present invention include olefinic copolymer rubbers such as ethylene-propylene copolymer rubber (EPM), and ethylene-propylene/non-conjugated diene copolymer rubber (EPDM); elastic bodies of shapeless random copolymer made mainly of olefin; and products which basically contains elastic body obtained by heat-treating the abovementioned rubber or elastic body in the presence of an organic peroxide and then crosslinking the heat-treated product mainly with radicals. Specific examples of the olefinic copolymer rubber include the abovementioned ethylene-propylene copolymer rubber (EPM), ethylene-1-butene copolymer rubber (EPM), ethylene-propylene-butene copolymer rubber, ethylene-hexene copolymer, ethylene-heptene copolymer, ethylene-octene copolymer, ethylene-4-methylpentene-1 copolymer, and ethylene/propylene/non-conjugated diene copolymer rubbers using, as an non-conjugated diene, an aliphatic diene such as butene-1, or 1,4-hexadiene, 5-ethylidenenorbornene, 5-methylnorbornene, 5-vinylnorbornene, dicyclopentadiene or dicyclooctadiene.

These copolymers or copolymer rubbers may be random copolymers, block copolymers, graft copolymers, or alternative copolymers. The production process thereof and the shape thereof are not particularly limited. These olefinic copolymer rubbers may be used alone or in combination of two or more kinds thereof.

About the molecular weight of the olefinic copolymer rubbers, the weight-average molecular weight thereof is preferably from 50,000 to 1,000,000, more preferably from 60,000 to 800,000, and still more preferably from 80,000 to 500,000. If the weight-average molecular weight is less than 50,000, rubber elasticity and mechanical strength may be poor. If the weight-average molecular weight is more than 1,000,000, the formability may be poor.

The ethylene content in the olefinic copolymer rubber is preferably from 30 to 90% by mass, preferably from 40 to 80% by mass. The Mooney viscosity $ML_{1+4}$ (100° C.) thereof is preferably from 5 to 400, more preferably from 10 to 350.

Examples of the olefinic thermoplastic elastomer including, as a base, such an olefinic copolymer rubber include "THERMORUN" made by MITSUBISHI CHEMICAL CORPORATION, "Milastomer" made by Mitsui Petrochemical Industries, Ltd., "Sumitomo TPE" made by Sumitomo Chemical Co., Ltd., and "Santoprene" made by Advanced Elastomer Systems.

Thermoplastic Resin

The kind of the thermoplastic resin used in the electroconductive member which is a semiconductive belt of the present invention is not particularly limited as long as the thermoplastic resin satisfies mechanical strength required for the semiconductive belt. Examples thereof include resin materials such as polyimide, polyetherimide, polyphenylenesulfide, polyethersulfone, polyether ether ketone, polyamide, polycarbonate and polyfluoride vinylidene (PVDF), and resin materials made mainly of any one of these resin materials. Among these materials, non-crystalline thermoplastic resins such as polycarbonate are preferably used from the viewpoint of workability.

Conductive Agent

The conductive agent used in the present invention is an agent used to cause the electroconductive composition to exhibit preferable conductivity. Examples of the conductive agent used in the present invention, as an electroconductive agent, include carbon materials such as carbon black, graphite and carbon fiber; metal powders such as aluminum and magnesium powders; metal materials such as metal fiber; and surface-treated metal oxide powder. Examples of the ion-conductive conductive agent include alkali metal peroxides such as lithium peroxide; perchlorates such as lithium perchlorate; quaternary ammonium salts such as a tetrabutyl ammonium salt; and phosphates. However, the kind of the conductive agent is not limited to the above.

Since the ion-conductive conductive agent is coordinately bonded to an atom having unpaired electrons in the thermoplastic elastomer or the thermoplastic resin, the conductive agent is dispersed uniformly at a molecular level in the elastomer or the resin. Therefore, variation in the resistance value, following dispersion poorness, is not generated, and image defects resulting from partial electrification poorness or the like are scarcely generated. However, there may be caused problems that the dependency of the resistance on environment and a resistance change by continuous sending of an electric current are generated. The blend amount of the ion-conductive agent is preferably from 0.1 to 5 parts by mass per 100 parts of the thermoplastic elastomer or the thermoplastic resin since the generation of bleeding must be suppressed. If the blend amount is more than 5 parts by mass, problems such as the generation of bleeding may be caused.

The electroconductive agent is preferably used in the present invention since there scarcely arise problems such as a resistance change based on environment and a resistance change based on continuous sending of an electric current, which are caused in the case in which the ion-conductive conductive agent is used.

As the electroconductive agent, acidic carbon black having a pH not more than 5 is preferably used. In the case in which the acidic carbon black having a pH not more than 5 is used, an excessive electric current flows in a part of the resultant product so that oxidization by repeated application of voltage does not easily produce an effect. Furthermore, by the effect of an oxygen-containing functional group adhering to the surface of carbon black, the dispersibility thereof in the electroconductive resin composition becomes high so that variation in resistance can be made small. Moreover, the dependency of the resistance on an electric field becomes small so that electric field concentration is not easily caused by sending of an electric current. As a result, in the semi-conductive belt of the present invention, the resistance change based on sending of an electric current is overcome and the uniformity of the electric resistance is improved. Furthermore, the dependency of the resistance on an electric field as well as resistance change based on environment can be reduced.

In the case of the electroconductive member of the present invention, the abovementioned results make it possible to prevent the following: electric field concentration, resulting from large aggregates of carbon black, for example, in a charging roll; leakage electric discharge such as pinhole leakage, which is considered to be generated by dielectric breakdown; and fixation of toner to the roll. Furthermore, the following are less caused: image quality defects resulting from electrification unevenness based on a change or variation in the resistance, and resulting from leakage electric discharge; and fluctuation of image density resulting from environmental changes. As a result, high-quality images can be obtained over a long time.

It is unnecessary that the acidic carbon black is subjected to coupling treatment for improving dispersibility and that insulating particles or metal oxides are added to the carbon black. Thus, the production process becomes simple.

The acidic carbon black is remarkably acidic, and has, on the surface thereof, very many functional groups such as oxygen-containing functional groups (carboxylic acid groups), hydroxyl groups (for example, phenolic hydroxyl groups), lactone groups, and quinoide groups. In general, the oxygen-containing functional groups of the surface of carbon black give polarity to carbon black having only carbon to improve the compatibility with binder resin or rubber. Thus, such carbon black can be uniformly dispersed in the resin or the rubber. This fact is widely recognized in systems containing a solvent, such as ink or paint. It can be presumed that this fact is also true even in the case in which kneading and dispersion are performed in a dry manner as performed in the present invention.

About the acidic carbon black used in the present invention, the pH thereof is preferably 5 or less, more preferably 4.5 or less, and still more preferably 4.0 or less. The pH is a physical property of carbon black, and is defined as follows (specifically, according to JIS K 6221-1982). That is, the "pH" means the pH (the logarithm value of a hydrogen ion concentration) of a mud-like product obtained by boiling carbon black in water, cooling the boiled product and removing the supernatant. This pH value is relevant to the amount of the oxygen-containing functional groups (such as carboxylic acid, hydroxyl, lactone, quinoide groups) of the surface of the carbon black. It is considered that as the pH value is smaller, the amount of the acid surface functional groups is larger (see "Carbon Black Handbook", edited and published by the Society of Carbon Black, 1995). As the physical property representing the amount of the oxygen-containing functional groups on the surface of carbon black, volatile matter content is also known. This volatile matter content represents, in percentage, a ratio of reduction in the amount of carbon black when the carbon black is kept in an atmosphere having a temperature of 950±25° C. for 7 minutes.

The acidic carbon black can be produced by a contact process. Examples of the contact process include channel and gas black processes. The acidic carbon black can also be produced by a furnace black process using gas or oil as a raw material. If necessary, liquid-phase acidizing treatment with nitric acid may be conducted after the abovementioned treatment. According to the furnace process, it is general that only carbon black having a high pH and a low volatile matter content is produced. However, this is subjected to the liquid-phase acidizing treatment, whereby the pH thereof can be adjusted. Therefore, carbon black whose pH is adjusted to 5 or less by post-treatment of carbon black obtained by the furnace process can also be used in the present invention.

Specific examples of the acidic carbon black used in the present invention "Color Black FW200" (pH: 2.5, volatile matter content: 20%), "Color Black FW2" (pH: 2.5, volatile matter content: 16.5%), "Color Black FW2V" (pH: 2.5, volatile matter content: 16.5%), "Special Black 6" (pH: 2.5, volatile matter content: 18%), "Special Black 5" (pH: 3, volatile matter content: 15%), "Special Black 4" (pH: 3, volatile matter content: 14%), "Special Black 4A" (pH: 3, volatile matter content: 14%), "Printex 150T" (pH: 4, volatile matter content: 10%), and "Printex 140U" (pH: 4.5, volatile matter content: 5%), each of which is made by Degussa Japan Co., Ltd.; and "REGAL 400R" (pH: 4.0, volatile matter content: 3.5%), "MONARCH 1000" (pH: 2.5, volatile matter content: 9.5%), and "MONARCH 1300" (pH: 2.5, volatile matter content: 9.5%), each of which is made by Cabot.

The acidic carbon blacks as described above may be mixed alone with the resin and so on, or two or more thereof may be arbitrarily blended in such a manner that properties such as mechanical strength, hardness and elastic modulus satisfy requirements from the whole of the system. The blend amount of the acidic carbon black in the electroconductive composition used in the present invention must be larger than the amount of ordinary electroconductive carbon black. If not so, a preferred resistance value cannot be obtained. The blend amount is preferably from 5 to 50 parts by mass per 100 parts of the epoxidized diene block copolymer and the thermoplastic elastomer, or the epoxidized diene block copolymer and the thermoplastic resin. If this blend amount is less than 5 parts by mass, the resistance is too large. As a result, for example, to a charging roll, electric charges sufficient to charge an electrostatic latent carrier may not be given. On the other hand, if the blend amount is more than 50 parts by mass, the resistance is too low. Thus, effects for preventing pinhole leakage and so on are not produced. Moreover, abnormal electric discharge is generated so that image quality defects such as voids may be generated.

Compound Having an Amino Group

For example, a polymer having a basic functional group has a basic (electron-donating) surface, and is selectively adsorbed to an acidic (electron-accepting) surface. Accordingly, the polymer having a basic functional group tends to be adsorbed to the acidic surface of carbon black having an acidic functional group such as a carboxyl group. On the basis of this fact, by adding the compound having a basic group together to the material containing the abovementioned electroconductive filler having a pH not more than 5.0, good dispersibility of oxidization-treated carbon black or the like can be obtained. Additionally, the compound having a basic group is adsorbed to the surface of the oxidization-treated carbon black having, e.g., a carboxyl group, so that adsorption of water content can be blocked.

That is, by use of the abovementioned composition, carbon black is satisfactorily dispersed in the abovementioned electroconductive resin composition so that a variation in the resistance of the semiconductive belt can be made small. In addition, the dependency of the resistance value on an electric field becomes small so that electric field concentration is not easily caused by transferring voltage. The compound having a basic group blocks the adsorption of water content onto the carboxyl group or the like of the carbon black surface, so as not to generate small projections of the surface of the semiconductive belt (electroconductive member), which are caused by gasification of adsorbed water, to be generated.

From the abovementioned viewpoint, in the case in which the thermoplastic resin is used as the material of the electroconductive member, the compound having an amino group is used together in the present invention.

The compound having an amino group, used in the electroconductive member of the present invention, is a compound having an amino group selectively adsorbed by acid-base mutual reaction to carboxyl and phenolic hydroxyl groups, which are acidic, out of the functional groups of the carbon black surface. If so, the kind of the compound is not particularly limited.

Examples of the compound having an amino group include primary amines such as N,N-dimethylaminoisopropylamine, N,N-dimethylaminoethylamine, 4,4'-diaminodiphenylmethane, 4,4'-diaminodiphenyl ether, and p-phenylenediamine; secondary amines such as piperidine and pyrrolidine; tertiary amines such as N,N,N',N'-tetramethylhexamethylenediamine, N,N,N',N'-tetramethylpropylenediamine, N,N,N',N",N"-pentamethyldiethylenetriamine, trimethylaminoethylpiperadine, N,N-dimethylcyclohexylamine, bis(2-dimethylaminoethyl) ether, N,N',N"-tris(3-dimethylaminopropyl)hexahydro-s-triazine, N,N-dimethylbenzylamine, N-methylmorpholine, N-ethylmorpholine, N-trioxyethylene-N,N-dimethylamine, triethylenediamine, 1,8-diazabicyclo(5,4,0)undecene-7, N,N,N-tris(3-dimethylaminopropyl)amine, N-methyldicyclohexylamine, N-methyl-N,N-bis(3-dimethylaminopropyl)amine, 2-(dimethylaminomethyl) phenol, 2,4,6-tris(dimethylaminomethyl)phenol, N,N'-dimethylpiperadine, pyridine, picoline, 1,2,2,6,6-pentamethyl-4-piperidinol, and triethylamine; and dicyandiamide.

All of these compounds having an amino group exhibit basicity. As the number of alkyl groups thereof is larger, the basicity thereof tends to be stronger. Accordingly, in the order of primary, secondary and tertiary amines, the basicity thereof becomes stronger. Therefore, tertiary amines are preferably used.

In the present invention, examples of the compound having an amino group include the abovementioned amines.

Among the abovementioned compounds having an amino group, the following is preferably used: a tertiary amino group-containing polymer dispersing agent "AJISPER PB711" made by Ajinomoto-Fine-Techno Co., Inc.

The mass ratio of the addition amount (A) of the electroconductive agent to the addition amount (B) of the compound having an amino group (A/B) is preferably from 1/0.5 to 1/5, more preferably from 1/0.8 to 1/1.2.

If the addition amount of the compound having an amino group does not satisfy "A/B is 1/0.5 or more", good dispersion stability of the acidic carbon black may not be obtained. Additionally, the effect of blocking the adsorption of water content onto carboxyl groups or the like of the acidic carbon black surface becomes small so that the gasification of the adsorbed water may cause a problem that defects such as small projections are generated in the surface of the semiconductive belt. On the other hand, if the addition amount of the compound having an amino group does not satisfy "A/B is 1/5 or less", problems such that mechanical strength for a belt falls may be caused.

The electroconductive resin composition used in the present invention can be produced by mixing the abovementioned respective constituents in a mixer such as a tumbler, a V-shaped blender, a Nauta mixer, a Bumbury's mixer, kneading rolls or an extruder. In the electroconductive resin composition and the production of the electroconductive resin composition, the method of mixing the respective constituents and the order of mixing the constituents are not particularly limited. An ordinary method is a method of mixing all the constituents beforehand in a tumbler, a V-shaped blender or the like and then melting/mixing the mixture homogeneously with an extruder. Dependently on the shapes of the constituents, a method of melting/mixing a melted mixture of two or more selected from the abovementioned constituents with the remaining constituents may be used.

If necessary, an additive besides the abovementioned constituents may be added to the electroconductive composition so far as the property of the composition is not damaged. Examples of the additive include a releasing agent, an antistatic agent, a light stabilizer, an antioxidant, a reinforcing agent, a softening agent, a foaming agent, a dye, a pigment, and an inorganic filler.

In a way as described above, the electroconductive composition used in the present invention can be obtained. The electroconductive member of the present invention includes the abovementioned electroconductive resin composition. As described above, this member can widely be used as an electroconductive member used in a charging device, a developing device, a transferring device or the like in an electrophotographic image forming apparatus. The electroconductive member of the present invention is preferably used as a semiconductive belt, which is used as an intermediate transfer member or a sheet carrying belt, or an electroconductive roll, which is used as a charging member and a transferring member.

Semiconductive Belt

By shaping the electroconductive resin composition obtained as described above into a desired sheet form or the like, an electroconductive member which is a semiconductive belt of the present invention can be obtained. If necessary, one or more layers may be formed on the surface of the semiconductive belt. In the case in which such layers are formed, the surface layer is preferably made of a low surface energy material to prevent toner dirt on the surface of the semiconductive belt or prevent dirt of the transferring member based on toner on the belt surface.

The low surface energy material is preferably a material wherein fluorine resin particles are dispersed. The kind of the fluorine resin particles is not particularly limited. Examples thereof include polyvinyl fluoride, PVDF, tetrafluoroethylene (TFE) resin, chlorotrifluoroethylene (CTFE) resin, ethylene-tetrafluoroethylene copolymer (ETFE), CTFE-ethylene copolymer, PFA (TFE-perfoluoroalkyl vinyl ether copolymer), FEP (TFE-hexafluoropropypene (HFP) copolymer), and EPE (TFT-HFP-perfoluoroalkyl vinyl ether copolymer). More specifically, an example of TFE resin powder is KTL-500F having an average particle size of 0.3 to 0.7 $\mu$m (made by Kitamura Limited).

The fluorine resin particles are dispersed in a resin material and used. Examples of this resin material include aliphatic polyester resins wherein polymer segments are bonded to each other in a linear chain form, such as VYLON 30SS, VYLON 200, and VYLON 300 made by TOYOBO CO., LTD., polyurethane resins having a soft segment in their molecule, and fluorine rubber. Since these resin materials themselves have flexibility, the resin materials can give flexibility to the surface coat layer. Thus, the generation of cracks or the like can be prevented.

The surface layer may contain a conductive agent. As this conductive agent, the abovementioned conductive agent can be used. From the viewpoint of costs, carbon black is particularly preferred.

The surface layer can be formed by applying the following onto the surface of the semiconductive belt: an electroconductive paint wherein appropriate amounts of PTFE (polytetrafluoroethylene) resin particles and carbon black are dispersed in an aliphatic polyester resin such as VYLON 30SS, VYLON 200, and VYLON 300 made by TOYOBO CO., LTD.; a water-emulsion paint Emralon 345ESD, Emralon JYL601ESD or Emralon JYL-804ESD, made by Acheson Japan Limited, wherein carbon black is dispersed in an urethane resin containing PTFE (polytetrafluoroethylene) resin particles; or NF-940 made by DAIKIN INDUSTRIES, LTD., wherein FEP (tetrafluoroethylene-hexafluoropropylene copolymer) and carbon black are dispersed in fluorine rubber.

As the method of applying the paint, a brush-coating, dipping, spray, roll coater or the like method can be used. It is preferred that the surface layer having a thickness of 3 to 60 $\mu$m is formed, for example, by the spray method. The thickness is more preferably set to 5 to 30 $\mu$m. If the thickness is less than 3 $\mu$m, the surface layer is worn off since the semiconductive belt contacts an intermediate transfer member or an electrostatic latent carrier repeatedly through a sheet under pressure. As a result, the elastic layer may be exposed. When the surface layer is formed by the dipping method, the film may not be easily made uniform. On the other hand, if the thickness is more than 60 $\mu$m, at the time of coating the elastic layer with the paint by the dipping method, a drip of the paint may easily be generated on the surface. Thus, a smooth and uniform paint coat may not be easily formed.

Electroconductive Roll

In the case in which the electroconductive member of the present invention is an electroconductive roll, the abovementioned electroconductive resin composition is formed as an electroconductive elastic layer on a surface of a substrate.

Substrate

The substrate functions as an electrode and supporting member of the etectroconductive member of the present invention. The substrate is made of an electroconductive material, for example, a metal or an alloy such as aluminum, a copper alloy or stainless steel; iron plated with chromium, nickel or the like; and electroconductive resin.

Electroconductive Elastic Layer

The electroconductive elastic layer is a layer for giving voltage for electrification or transfer by receiving a bias current from the substrate. The electroconductive member of the present invention may be applied, as a layer, onto a surface of the substrate and be formed of the substrate and one member (such as a roll type charging member or a roll type transferring member), or may be made of a member, which is different from the substrate, in a cylindrical film (belt) body, a brush or a blade form (such as a film type charging member, a brush type charging member, or a blade type charging member). As the charging member or the transferring member, the abovementioned roll type electroconductive roll is preferred.

The electroconductive roll can be formed as a cylindrical roll, for example, by applying the electroconductive resin composition to the substrate having an axial shape by means of an extruder. If necessary, the shaped roll surface may be grinded with a rotation-type grindstone grinder.

Protective Layer

The electroconductive member which is the electroconductive roll of the present invention may have a structure wherein only the electroconductive layer is formed on a surface of the substrate, or may further have a protective layer if necessary.

The material which constitutes the protective layer is preferably a material superior in non-adhesiveness to an electrostatic latent carrier or toner. Examples thereof include polyamide resin, fluorine resin, polyvinyl acetal resin, polyester resin, silicone resin, and resins made mainly thereof. By use of these non-adhesive materials for the protective layer, an excellent effect against contamination of an object to be electrified or adhesion of toner can be expected.

As a solvent of a coating solution for forming the protective layer, an ordinary organic solvent can be used. Examples thereof include methanol, ethanol, isopropanol, methyl ethyl ketone and toluene. To this coating solution, the following may be added: a conductive agent such as carbon black or a metal oxide; or a dispersing agent such as a surfactant or a coupling agent.

As the coating method, an ordinary coating method can be used. Examples thereof include spray, dipping and spin-coating methods. After the application of the coating solution, the solution is allowed to stand still at a room temperature or is heated to be dried and hardened. The thickness of the protective layer after being heated and hardened preferably ranges from 0.01 to 50 $\mu$m.

The hardness of the electroconductive roll produced as described above is preferably 60° or less, more preferably 50° or less as JIS-A hardness. If the JIS-A hardness is higher than 60°, at the time of using this roll, for example, as a charging member, nip uniformity between the roll and an object to be electrified is damaged. Thus, image quality defects are generated and further the surface of the object to be electrified may be gradually worn off when being used for a long time.

The JIS-A hardness is measured according to JIS K6301 using an electrostatic roll fashioned into a roll form.

Surface Resistivity

In the case in which an electroconductive member which is a semiconductive belt of the present invention is used as an intermediate transfer member, the surface resistivity of the transferring surface of the intermediate is preferably from $1\times10^{10}$ to $1\times10^{14}$ Ω/□, more preferably from $1\times10^{11}$ to $1\times10^{13}$ Ω/□. If the surface resistivity of the intermediate transfer member is higher than $10^{14}$ Ω/□, stripping electric discharge is generated at a post-nip section where an image carrier in a primary transferring section and the intermediate transfer member are stripped from each other. As a result, at the portion where the electric discharge is generated, an image quality defect of voids may be generated. If the surface resistivity is smaller than $1\times10^{10}$ Ω/□, electric field strength becomes strong at a pre-nip section so that gap electric discharge is easily generated at the pre-nip section. As a result, the granularity of images may deteriorate. Therefore, by setting the surface resistivity within the above-mentioned range, there do not arise problems of voids based on electric discharge, which is generated when the surface resistivity of the surface layer is high, and a fall in image quality, which is generated when the surface resistivity is low.

Figure 1B:
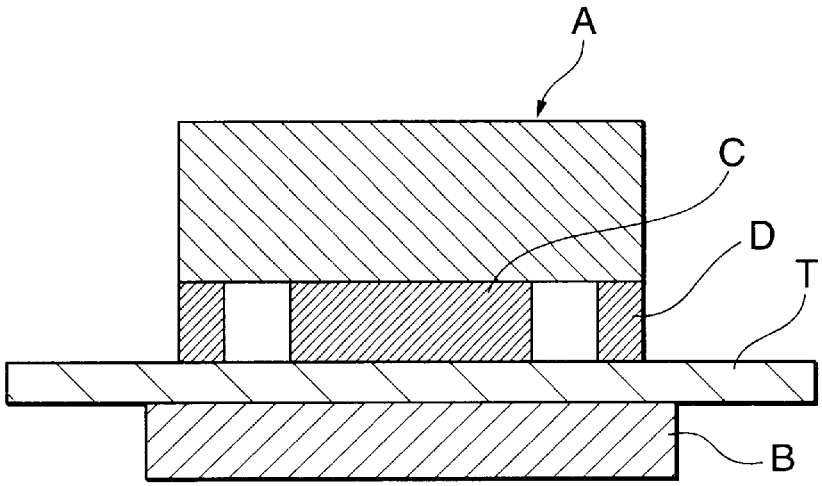
FIG. 1B is a schematic sectional view thereof.

The surface resistivity can be measured using a circular electrode (for example, an HR probe made by YUKADENSHI COMPANY LIMITED). Specifically, the surface resistivity can be measured using a circular electrode as illustrated in FIGS. 1A and 1B. FIG. 1A is a schematic plan view which illustrates one example of a circular electrode for measuring the surface resistivity, and FIG. 1B is a schematic sectional view thereof. The circular electrode illustrated in FIGS. 1A and 1B has a first voltage applying electrode A and a plate insulator B. The first voltage applying electrode A has a columnar electrode section C and a cylindrical ring electrode section D having a larger inner diameter than the outer diameter of the columnar electrode section C and surrounding the columnar electrode section C at a given interval. A semiconductive belt T to be measured is sandwiched between the columnar electrode section C and the ring electrode section D in the first voltage applying electrode A, and the plate insulator B. A voltage of 100 (V) is applied between the columnar electrode section C and the ring electrode section C in the first voltage applying electrode A. After 10 seconds, flowing current I (A) is measured. From the following equation (1), the surface resistivity ps (Ω/□) can be calculated:

$$ps=\pi\times(D+d)/(D-d)\times(100\ (V)/I) \qquad \text{Equation (1)}$$

wherein d (mm) represents the outer diameter of the columnar electrode section C. The surface resistivity is measured at 22° C. and 55% RH.

When the electroconductive member of the present invention is used as a semiconductive belt, the absolute value of a difference between the common logarithm of the surface resistivity ps1 (Ω/□) at an applied voltage of 100 V and the common logarithm of the surface resistivity ps2 (Ω/□) at an applied voltage of 1000 V, that is, |log ps1−log ps2| (the dependency of the surface resistivity upon an electric field) is preferably 0.6 (logΩ/□) or less, more preferably 0.5 (logΩ/□) or less. If the dependency of the surface resistivity upon an electric field is 0.6 or less, electric field concentration based on transferring voltage is not more easily caused when the member is used as an intermediate transfer member. It is therefore possible to prevent image quality defects as follows: for example, the surface resistivity of a sheet running section falls so that, in a halftone image, a void is generated in an image portion corresponding to the sheet running section.

In-plane variation in the surface resistivity is preferably 0.5 (logΩ/□) or less, more preferably 0.4 (logΩ/□) or less. If the in-plane variation is 0.5 or less, regions having locally large conductivity are few so that a problem that the surface resistivity is locally lowered is not easily caused. The in-plane variation in the surface resistivity is a difference between the common logarithm of the maximum value of the surface resistivity and that of the minimum value thereof in the surface of the semiconductive belt.

In the semiconductive belt, the absolute value of a difference between the common logarithm of the surface resistivity ps3 (Ω/□) at 30° C. and 85% RH and the common logarithm of the surface resistivity ps4 (Ω/□) at 10° C. and 15% RH, that is, |log ps3−log ps4| is preferably 1.0 (logΩ/□) or less, more preferably 0.6 (logΩ/□) or less.

In order to suppress the environment fluctuation width of the surface resistivity to 1.0 or less, it is effective to use the electroconductive agent. The surface resistivity is a value under the condition of an applied voltage of 100 V.

Volume Resistivity

In the case in which an electroconductive member which is a semiconductive belt of the present invention is used as an intermediate transfer member or a sheet carrying belt, the volume resistivity thereof is preferably from $1\times10^{6}$ to $1\times10^{12}$ Ωcm, more preferably $1\times10^{8}$ to $1\times10^{11}$ Ωcm.

For example, if the volume resistivity of the intermediate transfer member is lower than $10^{6}$ Ωcm, electrostatic power for holding electric charges of a non-fixed toner image transferred from an electrostatic latent image carrier to the intermediate transfer member comes not to act. As a result, the toner particles are scattered to the vicinity of the image (blur) by electrostatic repulsive power between the toner particles or fringe electric field power near the edge of the image. Thus, a problem that a very noisy image is formed is caused. If the volume resistivity of the intermediate transfer member is higher than $10^{12}$ Ωcm, there may arise a problem that power for holding electric charges is high and thus an electrification-removing mechanism becomes necessary for charging the surface of the intermediate transfer member by a transferring an electric field in a primary transfer.

Accordingly, by setting the volume resistivity within the range of $1\times10^{6}$ to $1\times10^{12}$ Ωcm, a problem that the above-mentioned toner scattering is generated or the electrification-removing mechanism is required is overcome.

The volume resistivity of the semiconductive belt can be measured with the measuring device illustrated in FIGS. 1A and 1B in the same way as in the case of the surface resistivity.

In FIGS. 1A and 1B, the semiconductive belt T is sandwiched between the columnar electrode section C and the ring electrode section D in the first voltage applying electrode A and the second voltage applying electrode B, and then a voltage of 100 (V) is applied between the columnar electrode section C in the first voltage applying electrode A and the second voltage applying electrode B. After 30 seconds, a flowing current I (A) is measured. In the case in which the outer diameter d of the columnar electrode section C is 16 mm, the surface resistivity pv (Ωcm) of the semiconductive belt T can be calculated from the following equation (2):

$$pv=19.6\times(100(V)/I)\times t \qquad \text{Equation (2)}$$

wherein t represents the thickness (cm) of the semiconductive belt T. The volume resistivity is measured at 22° C. and 55% RH.

In the case in which the electroconductive member of the present invention is an electroconductive roll, the volume resistivity of the electroconductive elastic layer thereof is preferably from $10^3$ to $10^{10}$ Ωcm. In the case in which the electroconductive roll is used as a charging member, the volume resistivity is more preferably from $10^5$ to $10^8$ Ωcm. In the case in which the electroconductive roll is used as a transferring member, the volume resistivity is more preferably from $10^6$ to $10^{10}$ Ωcm.

The volume resistivity is a value measured under the condition that a voltage of 1000 V/cm is applied to the electroconductive elastic layer fashioned into a roll form.

Number of Repeated Bendings over Rolls

In the case in which an electroconductive member which is a semiconductive belt of the present invention is used as a sheet carrying belt or an intermediate transfer member, the number of repeated bendings of the semiconductive belt over rolls is preferably 300 kcycles or more, more preferably 500 kcycles or more, and still more preferably 1000 kcycles or more according to a test device for measuring the number of repeated bendings to be described later.

If the number of repeated bendings is 300 kcycles or more, it is possible to suppress the generation of cracks of the belt by bending at a contact portion of the belt with a roll such as a driving roll or a tension roll.

Figure 2B:
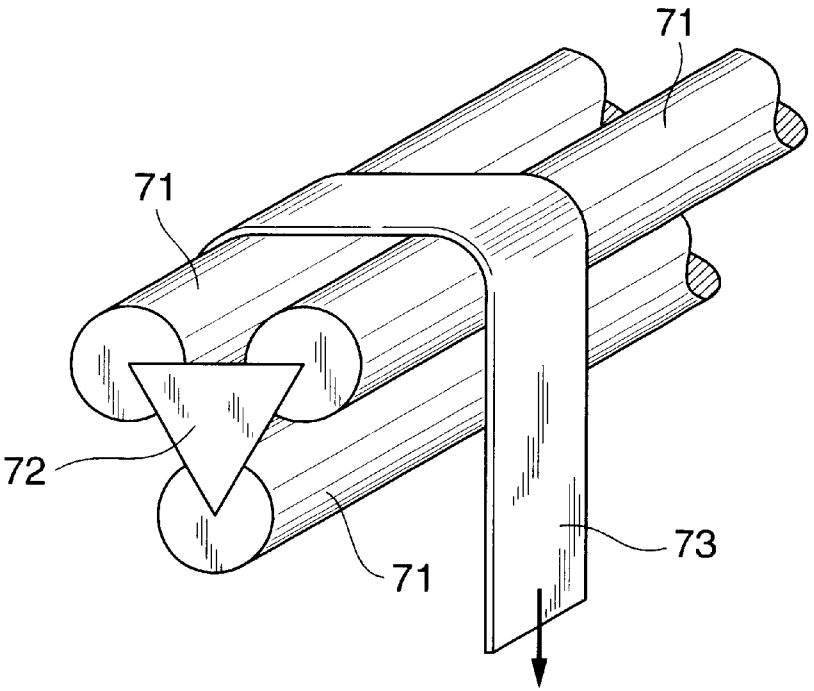
FIGS. 2A and 2B are schematic views illustrating an outline of a device for measuring the number of repeated bendings of a semiconductive belt over rolls.
Figure 2A:
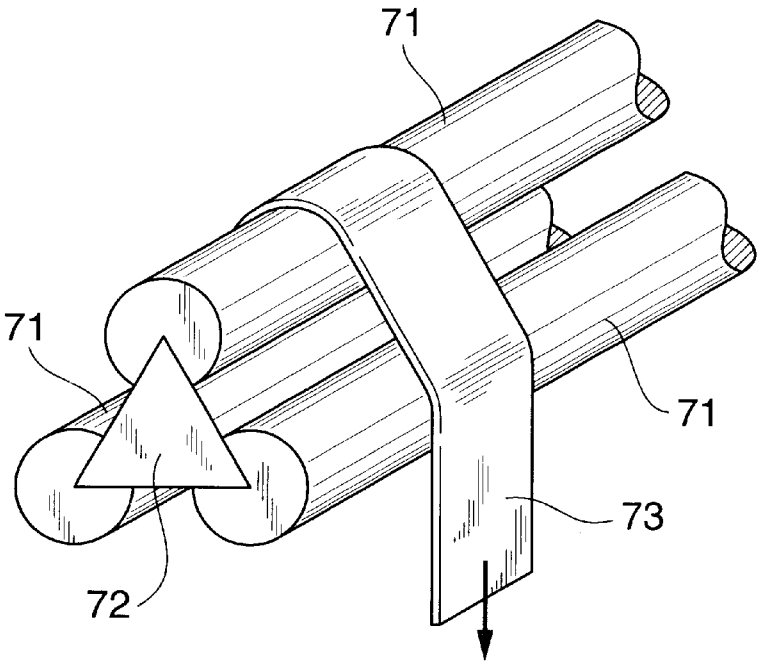

The number of repeated bendings can be measured with a measuring device illustrated in FIGS. 2A and 2B. The measuring device illustrated in FIGS. 2A and 2B has at least three metallic rolls 71 kept parallel to each other (diameter: 28 mm), and a regularly triangular fixing plates 72 (length of each side: 30 mm) fitted to the end faces of the rolls 71. The apex of the fixing plates 72 is consistent with the central axis of the metallic rolls 71. The metallic rolls 71 and the fixing plate 72 can rotate.

In order to measure the number of repeated bendings with the measuring device illustrated in FIGS. 2A and 2B, as illustrated in FIG. 2A, one end of a test piece (semiconductive belt) 73 having, e.g., a length of 300 mm and a width of 20 mm is fixed and a load of 400 g is suspended at the other end to apply tension to the belt. Next, as illustrated in FIG. 2B, the metallic rolls 71 are made to be freely rotated and further the fixing plate 72 is clockwise (in FIGS. 2A and 2B) rotated at a speed of 160 rpm. The three metallic rolls are used as one group, and one rotation is represented by 1 cycle. The number of the cycles until the test piece 73 is broken off is measured. The resultant number is defined as the number of repeated bendings over rolls.

Image Forming Apparatus

The kind of the image forming apparatus of the present invention is not particularly limited as long as the device is an image forming apparatus in an intermediate transfer member formula or in a sheet carrying belt formula. Examples thereof include an ordinary monochromic image forming apparatus wherein only monochromic toner is put in a developing device, a color image forming apparatus wherein a toner image carried on the surface of an electrostatic latent image carrier such as a photosensitive drum is primarily transferred to an intermediate transfer member and this step is successively repeated, and a tandem type color image forming apparatus wherein plural electrostatic latent image carriers having developing devices for respective colors are arranged in series on an intermediate transfer member.

The image forming apparatus of the present invention is provided with an electrostatic latent image carrier, a charging unit that charges the surface of the electrostatic latent image carrier uniformly, an exposing unit that exposes the surface of the electrostatic latent image carrier to light to form an electrostatic latent image, a developing unit that develops the electrostatic latent image formed on the surface of the electrostatic latent image carrier with an electrostatic image developer to form a toner image, a transferring unit that transfers the toner image to a surface of a transferring material, a fixing unit that fixes the toner image on the surface of the transferring material, a cleaning unit that removes toner and dirt adhering to an electrophotographic photoreceptor, an electrification-removing unit that removes the electrostatic latent image remaining on the surface of the electrostatic latent image carrier, and so on in a known manner when needed.

The electrostatic latent image carrier may be any known one. As the photosensitive layer thereof, a known layer such as an organic or amorphous silicon layer can be used. In the case in which the electrostatic latent image carrier is cylindrical, the carrier can be obtained by a known method, for example, a method of extruding aluminum or aluminum alloy and then subjecting the extruded product to surface working. The electrostatic latent image carrier in a belt form can be used.

The kind of the charging unit is not particularly limited. Examples thereof include known charging devices such as contact type charging devices using an electroconductive or semiconductive roll, brush, film, rubber blade or the like; and a scorotron or corotron charging device using corona discharge. Among these devices, the contact type charging devices are preferred since they are superior in electrification compensation ability. The charging unit usually applies a direct current to the electrophotographic photoreceptor (electrostatic latent image carrier). However, an alternative current may be further superposed thereon and applied thereto. The electrification can be preferably performed using the charging unit. The electrophotographic photoreceptor is usually electrified to, for example, −300 to −1000 V by means of such an charging unit.

The kind of the exposing unit is not particularly limited. Examples thereof include optical instruments capable of exposing, in a desired image form, the surface of the electrophotographic photoreceptor to light from a light source such as a semiconductor layer, an LED or a liquid crystal shutter, or through a polygon mirror from such a light source.

The developing unit may be a developing device appropriately selected dependently on a purpose. Examples thereof include known developing devices for developing a latent image with a single-composition developer or a two-component developer in a non-contact manner or a contact manner using a brush, a roll or the like.

The transferring unit may be a contact type transferring device wherein a transferring roll is brought into pressure contact with the rear surface of the semiconductive belt to transfer a toner image to an object to be transferred, a non-contact type transferring device wherein a corotron or the like is used to transfer a toner image to an object to be transferred.

Figure 3:
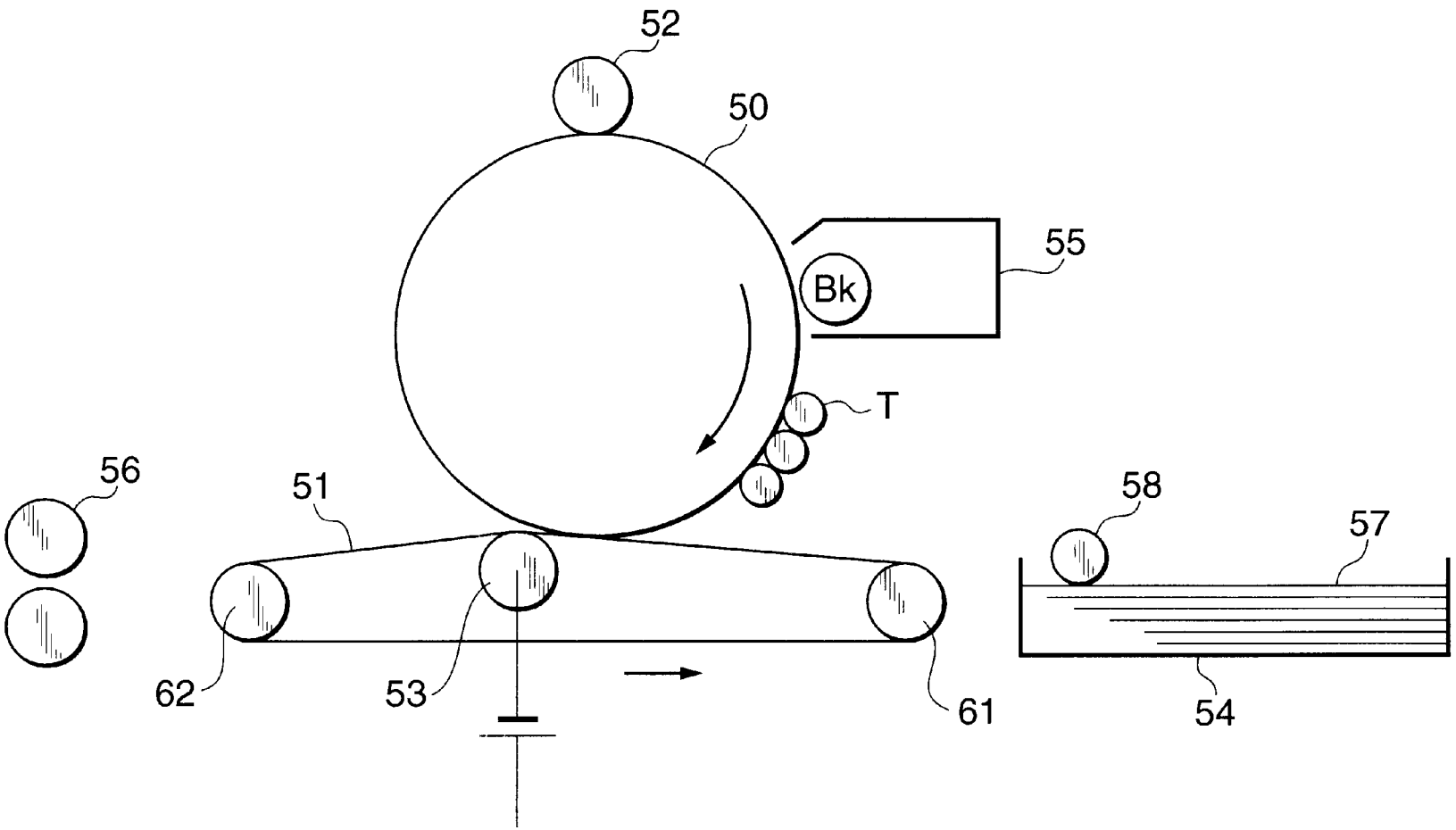
FIG. 3 is a schematic view illustrating one example of the image forming apparatus of the present invention.

The following will describe one example of the image forming apparatus of the present invention. FIG. 3 is a schematic view illustrating this example.

The image forming apparatus illustrated in FIG. 3 has an electrophotographic photoreceptor (electrostatic latent image carrier) 50, a recording paper carrying belt (sheet carrying belt) 51, a charging roll (charging member) 52, a transferring roll (transferring member) 53, a recording paper (recording medium) tray 54, a developing device 55, and a fixing device 56. As the recording paper carrying belt 51, a semiconductive belt of the present invention is set, and as the charging roll 52 and the transferring roll 53, electroconductive rolls of the present invention are set.

The charging roll 52, the developing device 55 using black (Bk) toner, and a non-illustrated exposing device are set in the vicinity of the electrophotographic photoreceptor 50. The electrophotographic photoreceptor 50 is arranged to be clockwise (in a direction shown by an arrow) rotated at a given peripheral velocity (process speed).

The recording paper carrying belt 51 can be counterclockwise (in a direction shown by an arrow) rotated at the same peripheral velocity as the electrophotographic photoreceptor 50 by means of supporting rolls 61 and 62. A portion of the belt 51, which is positioned in the middle of the supporting rolls 61 and 62, is arranged to contact the electrophotographic photoreceptor 50.

The transferring roll 53 is arranged inside the recording paper carrying belt 51 and at a position opposite to the portion where the recording paper carrying belt 51 and the electrophotographic photoreceptor 50 contact each other, and makes a transferring region (nip section) for transferring a toner image T onto the recording paper (recording medium) 57 through the electrophotographic photoreceptor 50 and the recording paper carrying belt 51.

The recording paper tray 54 has a pickup roll 58. By means of the pickup roll 58, the recording paper 57 is carried from the recording paper tray 54 to the recording paper carrying belt 51.

The fixing device 56 is arranged in such a manner that the recording paper can be carried after the paper is passed through the transferring region (nip section) between the electrophotographic photoreceptor 50 and the transferring roll 53 across the recording paper carrying belt 51.

In the image forming apparatus illustrated in FIG. 3, the electrophotographic photoreceptor 50 rotates in the direction shown in the arrow, so that its surface is uniformly electrified by the charging roll 52. The non-illustrated exposing device forms an electrostatic latent image in black (Bk) on the electrified electrophotographic photoreceptor 50. This electrostatic latent image is developed with toner by the developing device 55 so that a visualized toner image T is formed. The toner image T arrives at the transferring region (nip section) where the transferring roll 53 is arranged by the rotation of the electrophotographic photoreceptor 50. At the same time, the recording paper 57 is electrostatically adsorbed on the recording paper carrying belt 51 and carried to the transferring region (nip section). By applying a reversely-polar electric field to the toner image T from the transferring roll 53, the toner image T is electrostatically transferred onto the surface of the recording paper 57 adsorbed on the recording paper carrying belt 51. The recording paper 57 on which the toner image T is transferred by the transferring roll 53 is further carried to the fixing device 56 so that the toner image is fixed.

Through the abovementioned steps, a desired image is formed on the surface of the recording paper 57.

Figure 4:
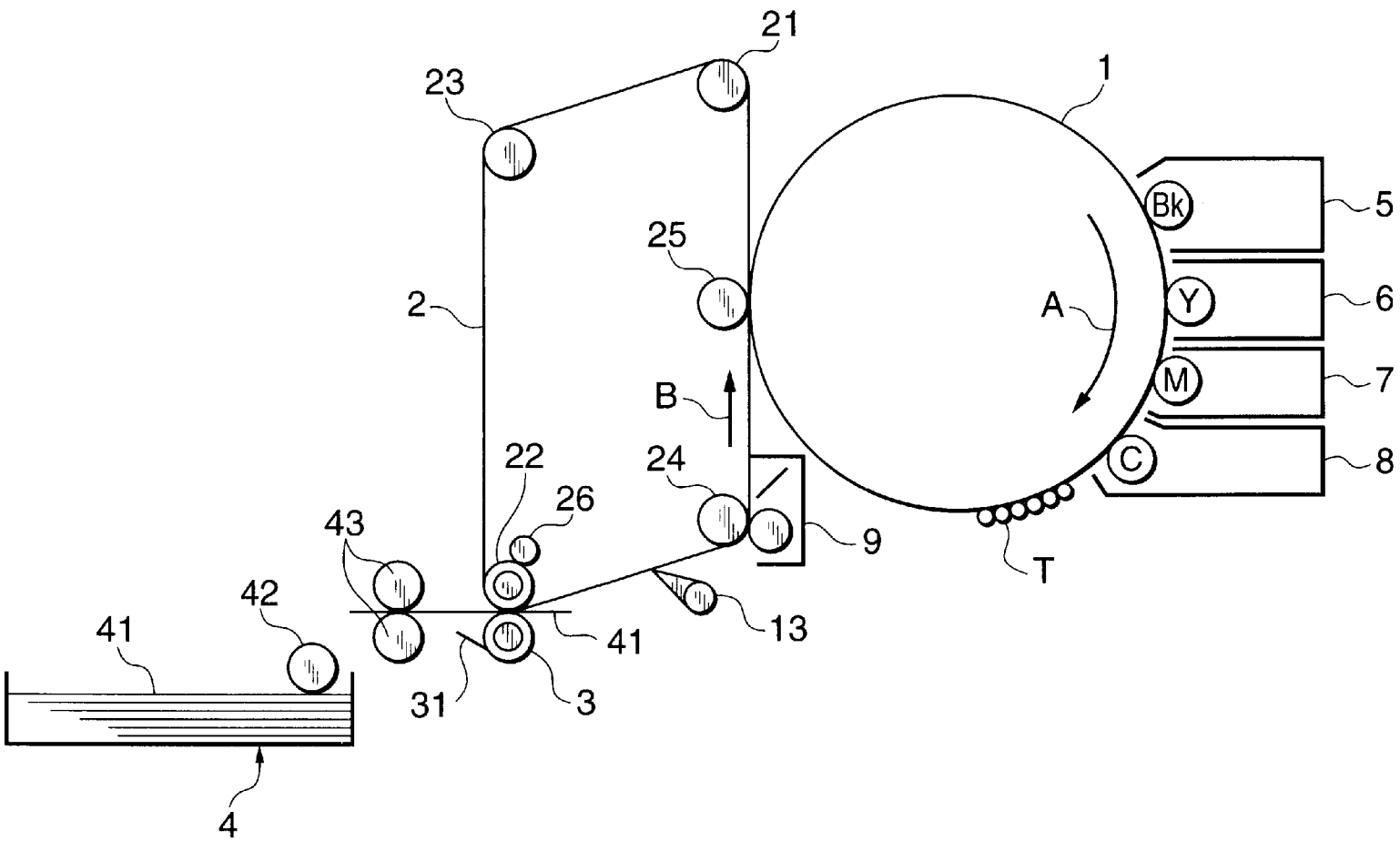
FIG. 4 is a schematic view illustrating another example of the image forming apparatus of the present invention.

FIG. 4 is a schematic view illustrating another example of the image forming apparatus of the present invention.

The image forming apparatus illustrated in FIG. 4 has a photosensitive drum 1 as an electrostatic latent carrier, a transferring belt 2 as an intermediate transfer member, a bias roll 3 as a transferring electrode, a tray 4 for supplying recording paper as a recording medium, a developing device 5 using black (Bk) toner, a developing device 6 using yellow (Y) toner, a developing device 7 using magenta (M) toner, a developing device 8 using cyan (C) toner, a belt cleaner 9, a scratcher 13, belt rolls 21, 23 and 24, a backup roll 22, an electroconductive roll 25, an electrode roll 26, a cleaning blade 31, a pickup roll 42, and field rolls 43. As the transferring belt 2, an electroconductive member which is a semiconductive belt of the present invention is set, and as the electroconductive roll, an electroconductive member which is an electroconductive roll of the present invention is set.

In FIG. 4, the photosensitive drum 1 rotates in a direction shown by an arrow A, and the surface thereof is uniformly electrified by a non-illustrated charging device. By an image writing unit such as a laser writing device, an electrostatic latent image in a first color (for example, Bk) is formed on the electrified photosensitive drum 1. This electrostatic latent image is developed by the developing device 5 to form a visualized toner image T. By the rotation of the photosensitive drum 1, the toner image T arrives at a primary transferring section where the electroconductive roll 25 is arranged. By applying a reversely-polar electric field to the toner image T from the transferring roll 25, the toner image T is primarily transferred by the rotation of the transferring belt 2 in a direction shown by an arrow B while the toner image T is electrostatically adsorbed on the transferring belt 2.

In the same way as described above, a toner image in a second color, a toner image in a third color and a toner image in a fourth color are successively formed, and the toner images are overlapped on the surface of the transferring belt 2. In this way, a multicolor toner image is formed.

The multicolor toner image transferred onto the transferring belt 2 arrives at a secondary transferring section where the bias roll 3 is set by the rotation of the transferring belt 2. The secondary transferring section is formed of the bias roll 3 set on the side of the surface of the transferring belt 2 where the toner image is carried, the backup roll 22 arranged oppositely to the bias roll 3 from the rear side of the transferring belt 2, and the electrode roll 26 which pressure-contacts this backup roll 22 to rotate.

Sheets of recording paper (recording medium) 41 are taken out one by one by the pickup roll 42 from a stack of recording paper sheets put in the recording paper tray 4, and are fed between the transferring belt 2 and the bias roll 3 in the secondary transferring section at a given timing by the feed rolls 43. The toner image carried on the surface of the transferring belt 2 is transferred onto the fed recording paper 41 by the carriage of the paper under contact and pressure between the bias roll 3 and the backup roll 22 and the rotation of the transferring belt 2.

By operating the scratcher 13, which is at a waiting position till the end of the primary transfer of the final toner image, the recording paper 41 on which the toner image is transferred is stripped from the transferring belt 2, and carried to a non-illustrated fixing device. The toner image is then fixed onto the recording paper 41 by pressing and heating treatment, so as to form a permanent image.

In the transferring belt 2 wherein the transfer of the multicolor toner image on the recording paper 41 is finished, remaining toner thereon is removed by the belt cleaner 9 set at a downstream position of the secondary transferring section. Thus, the belt 2 provides for the next transfer. The cleaning blade 31 made of polyurethane or the like is fitted to the bias roll 3 so that they contact each other at any time. Thus, the toner particles and alien substances such as paper powder adhered at the time of the transfer are removed.

In the case in which a monochromic image is transferred, the primarily-transferred toner image T is immediately subjected to secondary transfer so as to be carried to the fixing device. However, in the case in which a multicolor image based on overlapping of plural colors is transferred, the rotation of the transferring belt 2 is synchronized with that of the photoreceptor drum 1 so that the toner images in respective colors are not out of position. As a result, the toner images in the respective colors are consistent with each other in the primary transferring section.

In the secondary transferring section, a voltage (transferring voltage) having the same polarity as the toner image is applied, through the bias roll 3 and the transferring belt 2, to the electrode roll 26 brought into pressure contact with the oppositely-arranged backup roll 22, whereby the toner image is transferred to the recording paper 41 by electrostatic repulsion.

In the manner as described above, the toner image can be formed.

EXAMPLES

The present invention will be described by way of Examples hereinafter. The present invention is not limited to these examples.

Examples of Semiconductive Belts of the Present Invention and Comparative Examples

Example 1

Twenty parts by mass of an epoxidized diene black copolymer (trade name: Epofriend A1020, made by DAICEL CHEMICAL INDUSTRIES, LTD.) and 16 parts by mass of carbon black (trade name: Printex 140U, made by Degussa Japan Co., Ltd.) having a pH of 4.5 were mixed with 100 parts by mass of a polyamide thermoplastic elastomer (trade name: DIAMID-PAE X442, made by DAICEL-HULS LTD. Kabushiki Kaisha), and this mixture was blended and kneaded in a biaxial extruder to yield an electroconductive resin composition. Next, this electroconductive resin composition was shaped by means of a monoaxial extruder into a belt form having a thickness of 0.2 mm, a width of 350 mm and a circumferential length of 264 mm. In this way, a semiconductive belt was produced.

Example 2

Twenty parts by mass of an epoxidized diene black copolymer (trade name: Epofriend A1020, made by DAICEL CHEMICAL INDUSTRIES, LTD.) and 16 parts by mass of carbon black (trade name: Printex 140U, made by Degussa Japan Co., Ltd.) having a pH of 4.5 were mixed with 100 parts by mass of a thermoplastic elastomer containing a polyester component (trade name: Elastage ES5000A, made by TOSOH CORPORATION), and this mixture was blended and kneaded in a biaxial extruder to yield an electroconductive resin composition. Next, this electroconductive resin composition was shaped by means of a monoaxial extruder into a belt form having a thickness of 0.2 mm, a width of 350 mm and a circumferential length of 264 mm. In this way, a semiconductive belt was produced.

A water-emulsion paint (Emralon JYL-804ESD made by Acheson Japan Limited, solid content: 30% by mass), wherein carbon black and fluorine resin powder are added to an acrylic-modified urethane resin, was spray-pained onto the surface of the abovementioned semiconductive belt. Thereafter, the belt was heated at 100° C. for 35 minutes to form a surface layer having a thickness of 20 $\mu$m.

Comparative Example 1

To 100 parts by mass of chloroprene rubber (CR) (SKYPRENE, made by TOSOH CORPORATION) were added 13 parts by mass carbon black (KETJENBLACK, made by LION AKZO CO., LTD.), 1 part by mass of an organic peroxide (made by Kayaku Akzo Corporation) as a vulcanizing agent, 2 parts by mass of a vulcanization accelerator (NOCCELER, made by OUCHISHINKO CHEMICAL INDUSTRIAL CO., LTD.) and 1.5 part by mass of an age resistor (NOCRAC, made by OUCHISHINKO CHEMICAL INDUSTRIAL CO., LTD.), and this mixture was kneaded with a Bumbury's mixer. Thereafter, the mixture was extruded into a cylindrical form with an extruder. A vulcanizing can was used to heat and vulcanize the mixture at a temperature of 120° C. and a vapor pressure of 1.5 kg/cm$^2$ to yield an electroconductive rubber belt. Furthermore, this rubber belt was applied to the outside of a metallic substrate and then the surface was polished to yield a semiconductive belt (seamless belt) having a width of 320 mm, a circumferential length of 264 mm and a thickness of 0.5 mm.

A water-emulsion paint (Emuralon JYL-345ESD, made by Acheson Japan Limited), wherein 8 parts by mass of carbon black and 50 parts by mass of tetrafluoroethylene resin particles are dispersed in 100 parts by mass of urethane resin, was spray-pained onto the surface of the abovementioned belt. Thereafter, the belt was heated at 120° C. for 35 minutes to form a surface layer having a thickness of 20 $\mu$m. In this way, a semiconductive belt was produced.

Comparative Example 2

To 100 parts by mass of EPDM (EP-33, made by JSR Co.) were added 13 parts by mass of carbon black (KETJENBLACK, made by LION AKZO CO., LTD.), 2 parts by mass of sulfur 200 mesh (made by Tsurumi Chemical) as a vulcanizing agent, 2 parts by mass of a vulcanization accelerator (NOCCELER, made by OUCHISHINKO CHEMICAL INDUSTRIAL CO., LTD.) and 1.5 part by mass of an age resistor (NOCRAC MB, made by OUCHISHINKO CHEMICAL INDUSTRIAL CO., LTD.), and this mixture was kneaded with a Bumbury's mixer. Thereafter, the mixture was extruded into a cylindrical form with an extruder. A vulcanizing can was used to heat and vulcanize the mixture at a temperature of 120° C. and a vapor pressure of 1.5 kg/cm$^2$ to yield an electroconductive rubber belt. Furthermore, this rubber belt was applied to the outside of a metallic substrate and then the surface was polished to yield a semiconductive belt (seamless belt) having a width of 320 mm, a circumferential length of 264 mm and a thickness of 0.5 mm.

A water-emulsion paint (Emralon JYL-345ESD, made by Acheson Japan Limited), wherein 8 parts by mass of carbon black are dispersed in 100 parts by mass of urethane-modified tetrafluoro ethylene resin, was spray-pained onto the surface of the abovementioned semiconductive belt. Thereafter, the belt was heated at 120° C. for 35 minutes to form a surface layer having a thickness of 20 $\mu$m. In this way, a semiconductive belt was produced.

Comparative Example 3

Thirteen parts by mass of carbon black (KETJENBLACK, made by LION AKZO CO., LTD.) were added to 100 parts by mass of a polyamide thermoplastic elastomer (trade name: Diamide-PAE X442, made by DAICELHULS LTD. Kabushiki Kaisha), and this mixture was blended and kneaded in a biaxial extruder to yield an electroconductive resin composition. Next, this electroconductive resin composition was shaped by means of a monoaxial extruder to produce a semiconductive belt having a thickness of 0.2 mm, a width of 350 mm and a circumferential length of 264 mm.

Evaluation Tests

The semiconductive belts produced in Examples 1 and 2 and Comparative Examples 1 to 3 were subjected to the following evaluation tests.

Volume Resistivity

The ring electrode illustrated in FIG. 1 was used to apply a voltage of 500 V to each of the belts. After 30 seconds from the application, the current value was measured.

In-plane Variation in the Volume Resistivity

Each of the belts having a width of 320 mm and a circumferential length of 264 mm was divided into five parts in the width direction, and divided into five parts in the circumference direction. Thus, the volume resistivities at 25 points were measured. The in-plane variation was obtained as a difference between the maximum value and the minimum value out of the common logarithms of the respective volume resistivities.

Dependency of the Volume Resistivity upon Environment

The dependency was obtained as a difference between the common logarithm of the volume resistivity at a high temperature and high humidity (30° C. and 85% RH) and the common logarithm of the volume resistivity at a low temperature and low humidity (10° C. and 15% RH).

Bending Test

The measuring device illustrated in FIGS. 2A and 2B was used to measure the cycle number till each of the belt test pieces was broken off.

Belt Appearance

The surface of each of the belts was observed with the naked eye, and was evaluated on the basis of the following criterion:

A: no defects such as projections (20 μm high or more) producing an effect on image quality were observed in the surface.

C: projections (20 μm high or more) producing an effect on image quality were observed.

Resistance Change based on Continuous Sending of Electric Current

In the monochromic image forming apparatus illustrated in FIG. 3, each of the semiconductive belts was used as a sheet carrying belt. In an environment at 10° C. and 15% RH, 10000 sheets of A4 paper were continuously passed through the device. A change in the volume resistivities before and after the passage was measured.

Image Quality Evaluation

In the monochromic image forming apparatus illustrated in FIG. 3, each of the semiconductive belts was used as a sheet carrying belt. It was evaluated on the following criteria whether or not image quality defects such as line voids and toner scattering were observed in an initial image and an image after the passage of 10000 sheets of A4 paper through the device.

A: no problem about image quality was caused.

B: line voids, toner scattering and the like were slightly observed and a small problem about image quality was caused.

C: line voids, toner-scattering and the like were observed, and a problem about image quality was caused.

The evaluation results about the abovementioned items are collectively shown in Table 1.

TABLE 1

| | Example 1 | Example 2 | Comparative Example 1 | Comparative Example 2 | Comparative Example 3 |
|---|---|---|---|---|---|
| Volume resistivity: logΩcm | 9.5 | 9.6 | 9.4 | 9.1 | 9.5 |
| Variation in the volume resistivity ΔR: logΩ/□ | 0.6 | 0.5 | 1.1 | 0.9 | 1.2 |
| Change range of the surface resistivity by environment: logΩ/□ | 0.4 | 0.6 | 0.7 | 0.6 | 0.4 |
| Number of repeated bendings over rolls (× $10^3$ cycles) | 100 or more | 100 or more | 100 or more | 100 or more | 29 |
| Belt appearance | A | A | A | A | C |
| Drop in the volume resistivity after the passage of 10000 sheets of paper through the device (digit) | 0.4 | 0.3 | 1.2 | 0.9 | 0.8 |
| Initial image quality | A | A | B | B | C |
| Image quality after the passage of 10000 sheets of paper through the device | A | A | C | C | C |
| Total evaluation | A | A | C | C | C |

Example 3

As a thermoplastic resin, a polycarbonate resin (Lexane 131, made by Nippon GE Plastics) was used. To 100 parts by mass of this polycarbonate were added 20 parts by mass of an epoxidized diene block copolymer (Epofriend A1020, made by DAICEL CHEMICAL INDUSTRIES, LTD.), 18 parts by mass of acidic carbon black (Printex 150T, made by Degussa Co. In Germany) having a pH of 4.0, and 18 parts by mass of a tertiary amino group-containing polymer dispersing agent (AJISPER PB711, made by Ajinomoto-Fine-Techno Co., Inc.) as a compound having an amino group. This mixture was blended with a biaxial extruder to yield an electroconductive resin composition. A monoaxial extruder was used to extrude pellets of this electroconductive resin composition into a tube form at a raised temperature of 260° C. In this way, an endless belt (semiconductive belt) having a thickness of 0.13 mm, a width of 350 mm and an outer diameter of 168 mm was produced.

Example 4

As a thermoplastic resin, a polycarbonate resin (Lexane 131, made by Nippon GE Plastics) was used. To 100 parts by mass of this polycarbonate were added 20 parts by mass of an epoxidized diene block copolymer (Epofriend A1020, made by DAICEL CHEMICAL INDUSTRIES, LTD.), 18 parts by mass of acidic carbon black (Printex 140T, made by Degussa Co. in Germany) having a pH of 4.5, and 15 parts by mass of a tertiary amino group-containing polymer dispersing agent (AJISPER PB711, made by Ajinomoto-Fine-Techno Co., Inc.) as a compound having an amino group. This mixture was blended with a biaxial extruder to yield an electroconductive resin composition. A monoaxial extruder was used to extrude pellets of this electroconductive resin composition into a tube form at a raised temperature of 260° C. In this way, an endless belt (semiconductive belt) having a thickness of 0.13 mm, a width of 350 mm and an outer diameter of 168 mm was produced.

Example 5

As a thermoplastic resin, a polycarbonate resin (Lexane 131, made by Nippon GE Plastics) was used. To 100 parts by mass of this polycarbonate were added 10 parts by mass of an epoxidized diene block copolymer (Epofriend A1020, made by DAICEL CHEMICAL INDUSTRIES, LTD.), 18 parts by mass of acidic carbon black (Printex 150T, made by Degussa Co. in Germany) having a pH of 4.0, and 20 parts by mass of a tertiary amino group-containing polymer dispersing agent (AJISPER PB711, made by Ajinomoto-Fine-Techno Co., Inc.) as a compound having an amino group. This mixture was blended with a biaxial extruder to yield an electroconductive resin composition. A monoaxial extruder was used to extrude pellets of this electroconductive resin composition into a tube form at a raised temperature of 260° C. In this way, an endless belt (semiconductive belt) having a thickness of 0.13 mm, a width of 350 mm and an outer diameter of 168 mm was produced.

Comparative Example 4

As a thermoplastic resin, a polycarbonate resin (Lexane 131, made by Nippon GE Plastics) was used. To 100 parts by mass of this polycarbonate were added 15 parts by mass of carbon black (Printex 150T, made by Degussa Co. In Germany) having a pH of 4.0. This mixture was blended with a biaxial extruder to yield an electroconductive resin composition. A monoaxial extruder was used to extrude pellets of this electroconductive resin composition into a tube form at a raised temperature of 260° C. In this way, an endless belt (semiconductive belt) having a thickness of 0.13 mm, a width of 350 mm and an outer diameter of 168 mm was produced.

Comparative Example 5

As a thermoplastic resin, a polycarbonate resin (Lexane 131, made by Nippon GE Plastics) was used. To 100 parts by mass of this polycarbonate were added 14 parts by mass of carbon black (Volcan XC72X, made by Cabot Co. in USA) having a pH of 8.5. This mixture was blended with a biaxial extruder to yield an electroconductive resin composition. A monoaxial extruder was used to extrude pellets of this electroconductive resin composition into a tube form at a temperature of 220° C. In this way, an endless belt (semiconductive belt) having a thickness of 0.13 mm, a width of 350 mm and an outer diameter of 168 mm was produced.

Comparative Example 6

As a thermoplastic resin, a polycarbonate resin (Lexane 131, made by Nippon GE Plastics) was used. To 100 parts by mass of this polycarbonate were added 16 parts by mass of carbon black (granular acetylene black, made by DENKI KAGAKU KOGYO KABUSHIKI KAISHA) having a pH of 5.7. This mixture was blended with a biaxial extruder to yield an electroconductive resin composition. A monoaxial extruder was used to extrude pellets of this electroconductive resin composition into a tube form at a temperature of 260° C. In this way, an endless belt (semiconductive belt) having a thickness of 0.13 mm, a width of 350 mm and an outer diameter of 168 mm was produced.

Evaluation Tests

The belts produced in Examples 3 to 5 and Comparative Examples 4 to 6 were subjected to the following evaluation tests. About the electroconductive resin compositions used in the respective Examples and Comparative Examples, the water content therein was measured by Karl Fischer method in conformity to JIS K0068.

Volume Resistivity

In the same way as described above, the ring electrode illustrated in FIG. 1 was used to apply a voltage of 100 V to each of the belts. After 30 seconds from the application, the current value was measured. From the abovementioned equation (2), the volume resistivity was calculated.

Surface Resistivity

The ring electrode illustrated in FIG. 1 was used to apply a voltage of 100 V to each of the belts. After 10 seconds from the application, the current value was measured. From the abovementioned equation (1), the surface resistivity was calculated.

In-plane Variation in the Surface Resistivity

Each of the produced belts having an outer diameter of 168 mm and a width of 350 mm was divided into eight parts in the length (circumference) direction, and divided into three parts in the width direction. Thus, the surface resistivities at 24 points in the belt plane were measured. The in-plane variation ($\Delta R$) in the surface resistivity was obtained as a difference between the maximum value and the minimum value out of the common logarithms of the respective surface resistivities.

Change Range of the Surface Resistivity by Environment

The change range of the surface resistivity by environment was calculated as the absolute value of a difference between the common logarithm of the surface resistivity ps3 ($\Omega/\square$) at 30° C. and 85% RH and the common logarithm of the surface resistivity ps4 ($\Omega/\square$) at 10° C. and 15% RH, that is, $|\log ps3 - \log ps4|$.

Dependency of the Sheet Resistivity upon an Electric Field

The dependency of the sheet resistivity upon an electric field was calculated as the absolute value of a difference between the common logarithm of the surface resistivity ps1 ($\Omega/\square$) at an applied voltage of 100 V and the common logarithm of the surface resistivity ps2 ($\Omega/\square$) at an applied voltage of 1000 V, that is, $|\log ps1 - \log ps2|$.

A Fall Quantity of the Surface Resistivity

Each of the semiconductive belts was set as an intermediate transfer member onto the image forming apparatus illustrated in FIG. 4, and a fall quantity of the surface resistivity of the belt after 3000 postcards were passed through the device was calculated as a difference between the common logarithm of the surface resistivity before the passage of the postcards (initial stage) and the common logarithm of the surface resistivity of the postcard-passing portion after the 3000 postcards were continuously passed through the device.

Situation that Voids Were Generated in an Image

After the 3000 postcards were passed through the device, a halftone image of 30% magenta was outputted on paper (recording paper) of A4 size. It was judged with the naked eye whether or not voids were generated. A level at which no problem against image quality was caused was evaluated as A, and a level at which a problem against image quality was caused evaluated as C.

Belt Appearance

Figure 5:
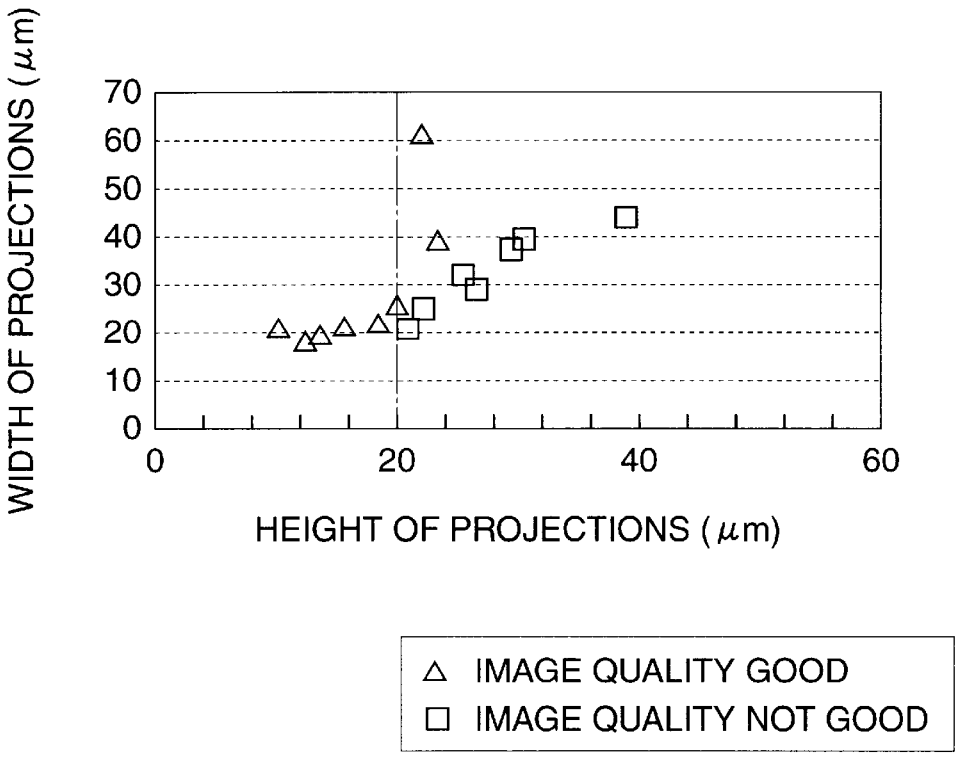
FIG. 5 is a graph showing a relationship between the shape (height and width) of projections of the surface of a belt and image quality defects.

The outside face of each of the endless belts was observed with a three-dimensional roughness meter, and the image forming apparatus illustrated in FIG. 4 was used to output a halftone image. FIG. 5 is a graph showing relationship between the height and the width of the projections of the belt surface of the intermediate transfer member and the quality of the transferred image in this case. As can be understood from FIG. 5, when the height of the projections of the belt surface was more than 20 μm, image defects of voids were generated in the transferred image. From this result, the belt appearance was evaluated according to the following criteria depending on the number of projections having a height of 20 μm or more.

A: level at which no problem against image quality was caused.

B: projections having a height of 10 to 20 μm were observed, but no problem against image quality was caused.

C: a great number of projections having a height of 20 μm or more were observed, and a problem against image quality was caused.

The blend compositions and the evaluation results of the respective resin belts are collectively shown in Table 2.

TABLE 2

| | Example 3 | Example 4 | Example 5 | Comparative Example 4 | Comparative Example 5 | Comparative Example 6 |
|---|---|---|---|---|---|---|
| Kind of conductivity | Electron-conductive | Electron-conductive | Electron-conductive | Electron-conductive | Electron-conductive | Electron-conductive |
| Resin composition | Poly-carbonate | Poly-carbonate | Poly-carbonate | Poly-carbonate | Poly-carbonate | Poly carbonate |
| Epoxidized diene block copolymer | 20 | 20 | 20 | 0 | 0 | 0 |
| pH of carbon black | 4.0 | 4.5 | 4.0 | 4.0 | 9.0 | 5.7 |
| Addition amount (A) of carbon black | 18 | 18 | 18 | 15 | 14 | 16 |
| Addition amount (B) of amino compound | 18 | 15 | 15 | 0 | 0 | 0 |
| A:B | 1:1 | 1:0.8 | 1:1.2 | — | — | — |
| Surface resistivity: logΩ/□ | 11.9 | 12.0 | 11.8 | 11.8 | 11.9 | 11.4 |
| Volume resistivity: logΩcm | 10.4 | 10.6 | 10.0 | 10.6 | 8.2 | 9.8 |
| Variation in the surface resistivity ΔR: logΩ/□ | 0.3 | 0.5 | 0.5 | 0.6 | 1.3 | 1.1 |
| Change range of the surface resistivity by environment: logΩ/□ | 0.2 | 0.3 | 0.3 | 0.3 | 0.2 | 0.3 |
| Dependency of the surface resistivity upon an electric field: logΩ/□ | 0.3 | 0.3 | 0.3 | 0.5 | 1.1 | 0.9 |
| Fall quantity of the surface resistivity of the paper-passing portion after an image was duplicated on 3000 sheets of paper | 0.3 | 0.3 | 0.4 | 0.5 | 2.3 | 2.1 |
| Generation of image defects (voids) after an image was duplicated on 3000 sheets of paper | A | A | A | A | C | C |
| Number of repeated bendings over rolls (× $10^3$ cycles) | 1500 | 1530 | 1200 | 75 | 85 | 95 |
| Water content (%) | 0.2 | 0.4 | 0.6 | 2.1 | 1.2 | 1.1 |
| Belt appearance | A | A | A | C | B | B |

Examples of Electroconductive Members which are Electroconductive Rolls of the Present Invention, and Comparative Examples Example 6

To 100 parts by mass of a styrene-based thermoplastic elastomer (RABALON T331C, made by MITSUBISHI CHEMICAL CORPORATION) were added 20 parts by mass of carbon black (Printex 140U, made by Degussa Japan Co., Ltd.) having a pH of 4.5 and 10 parts by mass of an epoxidized diene block copolymer (Epofriend A1020, made by DAICEL CHEMICAL INDUSTRIES, LTD.). This mixture was blended with a biaxial extruder to yield an electroconductive resin composition made into pellets. This electroconductive resin composition was shaped with an extruder to cover a core axis (diameter: 6 mm) made of stainless steel, to form an electroconductive elastic layer. In this way, a charging roll having a diameter of 14 mm was produced.

Example 7

To 100 parts by mass of a styrene-based thermoplastic elastomer (RABALON T331C, made by MITSUBISHI CHEMICAL CORPORATION) were added 20 parts by mass of carbon black (Printex 140U, made by Degussa Japan Co., Ltd.) having a pH of 4.5 and 20 parts by mass of an epoxidized diene block copolymer (Epofriend A1020, made by DAICEL CHEMICAL INDUSTRIES, LTD.). This mixture was blended with a biaxial extruder to yield an electroconductive resin composition made into pellets. This electroconductive resin composition was shaped with an extruder to cover a core axis (diameter: 6 mm) made of stainless steel, to form an electroconductive elastic layer. In this way, a charging roll having a diameter of 14 mm was produced.

Example 8

To 100 parts by mass of an olefin-based thermoplastic elastomer (Santoprene 211–55, made by AES Japan Co.) were added 20 parts by mass of carbon black (Printex 140U, made by Degussa Japan Co., Ltd.) having a pH of 4.5 and 20 parts by mass of an epoxidized diene block copolymer (Epofriend A1020, made by DAICEL CHEMICAL INDUSTRIES, LTD.). This mixture was blended with a biaxial extruder to yield an electroconductive resin composition made into pellets. This electroconductive resin composition was shaped with an extruder to cover a core axis(diameter: 6 mm) made of stainless steel, to form an electroconductive elastic layer. In this way, a charging roll having a diameter of 14 mm was produced.

Example 9

A charging roll was produced in the same way as in Example 7. Tin oxide was added to a polyamide resin solution (Diamide T-171 (solid content: 30% by mass), made by DAICELHULS LTD.) in such a manner that the amount of the tin oxide would be 60% by mass of the whole solid content in the resin solution. The mixture was blended with a sand mill to yield a coating solution (resistance of the coated film: $2\times10^{10}$ Ωcm). This coating solution was applied to the surface of the electroconductive elastic layer of the charging roll by a dipping method, to form a protective layer having a thickness of 7 μm. In this way, the charging roll having the protective layer was formed.

Comparative Example 7

To 100 parts by mass of a styrene-based thermoplastic elastomer (RABALON T331C, made by MITSUBISHI CHEMICAL CORPORATION) were added 20 parts by mass of carbon black (DENKA BLACK, made by DENKI KAGAKU KOGYO KABUSHIKI KAISHA). This mixture was blended with a biaxial extruder to yield an electroconductive resin composition made into pellets. This electroconductive resin composition was shaped with an extruder to cover a core axis (diameter: 6 mm) made of stainless steel, to form an electroconductive elastic layer. In this way, a charging roll having a diameter of 14 mm was produced.

Comparative Example 8

To 100 parts by mass of an olefin-based thermoplastic elastomer (Santplain 211–55, made by AES Japan Co.) were added 16 parts by mass of carbon black (DENKA BLACK, made by DENKI KAGAKU KOGYO KABUSHIKI KAISHA). This mixture was blended with a biaxial extruder to yield an electroconductive resin composition made into pellets. This electroconductive resin composition was shaped with an extruder to cover a core axis(diameter: 6 mm) made of stainless steel, to form an electroconductive elastic layer. In this way, a charging roll having a diameter of 14 mm was produced.

Comparative Example 9

To 100 parts by mass of a thermoplastic elastomer containing a polyester component (Elastage ES5000A, made by TOSOH CORPORATION) were added 16 parts by mass of carbon black (DENKA BLACK, made by DENKI KAGAKU KOGYO KABUSHIKI KAISHA). This mixture was blended with a biaxial extruder to yield an electroconductive resin composition made into pellets. This electroconductive resin composition was shaped with an extruder to cover a core axis (diameter: 6 mm) made of stainless steel, to form an electroconductive elastic layer. In this way, a charging roll having a diameter of 14 mm was produced.

Evaluation Test

Examples 6 to 9 and Comparative Examples 7 to 9 were evaluated as follows.

Permanent Compression Strain

Each of the materials used in the abovementioned Examples and Comparative Examples was kneaded with a biaxial kneading extruder to prepare an electroconductive resin component made into pellets. Next, the pellets were molded into electroconductive resin composition sheets (100 mm×100 mm×2 mm) with an injection molding machine. The sheets, the number of which was 7, were overlapped and adhered closely to each other. Thereafter, the resultant lamination was polished to have a thickness of 12.7 mm, and was then hollowed out into a right circular cylinder having a diameter of 29 mm. In this way, a test piece for measuring permanent compression strain was produced. This test piece for measuring permanent compression strain and a spacer having a thickness of 9.52 mm were set to a permanent compression strain tester (in accordance with JIS K6301, made by Kobunshi Keiki Kabushiki Kaisha), to compress the test piece by 25%. In this state, the test piece was heated at 70° C. for 22 hours. Next, the test piece was allowed to stand still at room temperature (25° C.). After 30 minutes, the thickness was measured. From the following equation (3), the permanent compression strain CS (%) was calculated on the basis of the measured thickness:

$$CS=(t_0-t_1)/(t_0-t_2)\times100 \quad \text{Equation (3)}$$

wherein to represents the original thickness (mm) of the test piece, $t_1$ represents the thickness (mm) after 30 minutes from the taking-out of the test piece from the compression machine, and $t_2$ represents the thickness (mm) of the spacer.

Hardness

In accordance with the measuring specification of JIS K6301, the hardness of the electroconductive resin composition in a roll form was measured with a JIS-A hardness meter (made by Kobunshi Keiki Kabushiki Kaisha).

Volume Resistivity

With a digital superhigh resistance/minute current meter (R8340A, made by Advan Test Co.), a voltage was applied to the electroconductive resin composition in a roll form to give 1000 V/cm. After 10 seconds, the electric current value was measured and the volume resistance was calculated from the equation (2).

Range (V) of Variation in the Surface Voltage

Each of the abovementioned charging rolls was used as a charging member and a drum-form organic photoreceptor (for DocuPrint C411, made by Fuji Xerox) was used as an electrostatic latent image carrier to make the image forming apparatus illustrated in FIG. 3. A surface voltage meter was set at a position where a developing roll was disposed, so as to measure the range (V) of a variation in the surface voltage in the circumference of the organic photoreceptor. The results were evaluated on the basis of the following criteria:

A: less than 20 V (image quality unevenness was not generated).

B: 20 V or more and less than 30 V (image quality unevenness was slightly generated, but a serious problem against image quality was not caused).

C: 30 V or more (image quality unevenness was generated and a problem against image quality was caused).

Pinhole Test

Each of the abovementioned charging rolls was used as a charging member and a drum-form organic photoreceptor (for DocuPrint C411, made by Fuji Xerox) was used as an electrostatic latent image carrier to form images by means of the image forming apparatus illustrated in FIG. 3 and evaluate the images. In this case, a voltage to be applied to the charging roll was set to DC-1600V. It was judged on the following criteria whether or not the concentration of voltage to pinholes in the photoreceptor and the generation of abnormal electric discharge were generated:

A: a void based on abnormal electric discharge was not caused and the diameter of a void was less than 2 mm.

B: the diameter of a void was 2 mm or more, but no streak was generated.

C: a streak-like void was generated in the image.

Bleeding Test

Each of the abovementioned rolls was pressed against a new drum-form organic photoreceptor (for DocuPrint C411, made by Fuji Xerox) with a load of 1 kg. This device was allowed to stand still at 45° C. and 95% RH for a week, and then adapted to ordinary environment all day and night. Images were then formed, and it was checked whether the photoreceptor was contaminated or not. In the case in which the photoreceptor is contaminated, the contaminated portion is not electrified so that an abnormal image (void) makes its appearance. The roll was evaluated on the basis of the following criteria (as to whether or not the void was generated in a halftone image):

A: no void was generated.

C: a void was generated.

Actual Machine Test

As a charging member, each of the abovementioned rolls was used. This roll and a new organic photoreceptor were mounted on a modified machine (modified "DocuPrint C411", made by Fuji Xerox). An image was duplicated on 30,000 papers.

The modified "DocuPrint C411" was modified as follows. (1) Its charging member was replaced by each of the members produced in the abovementioned Examples and Comparative Examples. (2) A cleaning blade made of polyurethane was set near a transferring roll used as a transferring member, and the blade was brought into contact with the transferring roll only when toner was removed. (3) In addition to an ordinary duplicating cycle, a toner-removing mode, was carried out whenever the image was duplicated on 20 sheets and when the printer was started up. (4) The original machine is provided with a cleaning blade, made of polyurethane and contacting an electrostatic latent carrier (photoreceptor), and a toner collecting device. However, for the present evaluation, the blade contacting the photoreceptor was removed. The original machine is a color printer. However, the image for evaluation was duplicated in a monochromic mode.

Image qualities before and after the actual machine test onto 30,000 sheets were compared, and evaluation was made on the basis of the following criteria:

A: no problem against image quality was caused.

C: density unevenness was generated in the image.

The blend compositions of the respective rolls and the evaluation results are collectively shown in Table 3.

TABLE 3

| | Example 6 | Example 7 | Example 8 | Example 9 | Comparative Example 7 | Comparative Example 8 | Comparative Example 9 |
|---|---|---|---|---|---|---|---|
| Thermoplastic elastomer (TPE) | Styrene-based TPE | Styrene-based TPE | Olefin-based TPE | Styrene-based TPE | Styrene-based TPE | Olefin-based TPE | Polyester-based TPE |
| Epoxidized diene block polymer (parts by weight) | 10 | 20 | 20 | 20 | 0 | 0 | 0 |
| pH of conductant agent | 4.5 | 4.5 | 4.5 | 4.5 | 5.7 | 5.7 | 5.7 |
| Surface layer | Not deposited | Not deposited | Not deposited | Deposited | Not deposited | Not deposited | Not deposited |
| Hardness (°) | 45 | 46 | 46 | 46 | 49 | 50 | 52 |
| Volume resistivity: logΩcm | $4 \times 10^7$ | $6 \times 10^7$ | $4 \times 10^7$ | $2 \times 10^8$ | $4 \times 10^7$ | $6 \times 10^7$ | $6 \times 10^7$ |
| Permanent compression strain (%) | 25 | 24 | 25 | 24 | 38 | 32 | 32 |
| Range (V) of variation in charging voltage | 13 | 14 | 15 | 12.0 | 28 | 32 | 35 |
| Pinhole leakage | A | A | A | A | B | C | C |
| Photoreceptor contamination | A | A | A | A | A | A | B |
| Image quality after the image was duplicated on 30,000 sheets of paper | A | A | A | A | C | Not evaluated | Not evaluated |
| Total evaluation | A | A | A | A | C | C | C |

According to the present invention, a thermoplastic elastomer material having advantages of a cutback in energy in the production process thereof and of being recyclable is used as an electroconductive resin composition, so as to provide an electroconductive member making it possible to prevent a resistance change based on sending of an electric current, improve the uniformity of electric resistance, reduce a resistance change based on environment change, and attain uniform and stable electrification, transfer and so on.

The entire disclosure of Japanese Patent Application No. 2002-71820 filed on Mar. 15, 2002 including specification, claims, drawings and abstract is incorporated herein by reference in its entirety.

What is claimed is:

1. An electroconductive member comprising an electroconductive resin composition having an epoxidized diene block copolymer, a conductive agent and one of a thermoplastic elastomer other than the epoxidized diene block copolymer and a thermoplastic resin.

2. The electroconductive member according to claim 1, wherein the epoxidized diene block copolymer comprises, in a single molecule, a polymer block made mainly of a vinyl aromatic compound and one of a polymer block made mainly of a conjugated diene compound partially containing an epoxy group and a polymer block made mainly of a hydrogenated conjugated diene compound partially containing an epoxy group.

3. The electroconductive member according to claim 1, wherein the conductive agent is an electroconductive agent.

4. The electroconductive member according to claim 3, wherein the electroconductive agent is carbon black having a pH not more than 5.

5. The electroconductive member according to claim 1, wherein the electroconductive resin composition comprises the epoxidized diene block copolymer, the thermoplastic elastomer other than the epoxidized diene block copolymer and the conductive agent, the member being a semiconductive belt comprising the electroconductive resin composition.

6. The electroconductive member according to claim 5, wherein the thermoplastic elastomer other than the epoxidized diene block copolymer is a polyester thermoplastic elastomer or a polyamide thermoplastic elastomer.

7. The electroconductive member according to claim 5, wherein the volume resistivity of the electroconductive resin composition ranges from approximately $10^6$ to $10^{12}$ Ωcm.

8. The electroconductive member according to claim 5, wherein at least one layer is formed over a surface of the electroconductive member which is the semiconductive belt, and the surface layer of the electroconductive member comprises a low surface energy material.

9. The electroconductive member according to claim 8, wherein the low surface energy material is a material wherein fluorine resin particles are dispersed.

10. The electroconductive member according to claim 5, wherein the absolute value of a difference between common logarithm of a surface resistivity ps1 (Ω/□) at an applied voltage of 100 V and common logarithm of a surface resistivity ps2 (Ω/□) at an applied voltage of 1000 V, that is, |log ps1−log ps2|, is 0.6 or less.

11. The electroconductive member according to claim 5, wherein the absolute value of a difference between common logarithm of a surface resistivity ps3 (Ω/□) at 30° C. and 85% RH and common logarithm of a surface resistivity ps4 (Ω/□) at 10° C. and 15% RH, that is, |log ps3−log ps4|, is 1.0 or less.

12. The electroconductive member according to claim 5, wherein the number of repeated bendings of the member over rolls is 300 kcycles or more.

13. The electroconductive member according to claim 1, wherein the electroconductive resin composition comprises the epoxidized diene block copolymer, the thermoplastic resin, a compound having an amino group and the conductive agent, the member being a semiconductive belt comprising the electroconductive resin composition.

14. The electroconductive member according to claim 13, wherein the thermoplastic resin is a polycarbonate resin.

15. The electroconductive member according to claim 13, wherein the compound having the amino group is a tertiary amino group-containing polymer compound.

16. The electroconductive member according to claim 1, wherein the electroconductive resin composition comprises the epoxidized diene block copolymer, the thermoplastic elastomer other than the epoxidized diene block copolymer and the conductive agent, the member being an electroconductive roll, wherein an electroconductive elastic layer comprising the electroconductive resin composition is formed on a surface of a substrate.

17. The electroconductive member according to claim 16, wherein the thermoplastic elastomer other than the epoxidized diene block copolymer is a styrene-based thermoplastic elastomer or an olefinic thermoplastic elastomer.

18. The electroconductive member according to claim 16, wherein a volume resistivity of the electroconductive elastic layer ranges from $10^3$ to $10^{10}$ Ωcm.

19. The electroconductive member according to claim 16, wherein a protective layer is formed over a surface of the electroconductive elastic layer.

20. An image forming apparatus comprising:

an electrostatic latent image holding member on which an electrostatic latent image is formed;

a charging unit that uniformly charges the surface of the electrostatic latent image holding member;

an exposure unit that exposes the surface of the electrostatic latent image holding member;

a developing unit that develops the electrostatic latent image by using a developer for electrostatic charge image to form a toner image;

a transfer unit that transfers the toner image onto the surface of the transfer material;

a fusing unit that fuses the toner image on the surface of the transfer material;

a cleaning unit that removes a toner or dust attached to the electrostatic latent image holding member; and a discharging unit that discharges the electrostatic latent image remaining on the electrostatic latent image holding member, wherein the transfer unit comprises a transfer material carrying unit using a semiconductive belt comprising an electroconductive resin composition containing an epoxidized diene block copolymer, a thermoplastic elastomer other than the epoxidized diene block copolymer and a conductive agent.

21. An image forming apparatus comprising:

an electrostatic latent image holding member on which an electrostatic latent image is formed;

a charging unit that uniformly charges the surface of the electrostatic latent image holding member;

an exposure unit that exposes the surface of the electrostatic latent image holding member;

a developing unit that that develops the electrostatic latent image by using a developer for electrostatic charge image to form a toner image;

a transfer unit that transfers the toner image onto the surface of the transfer material;

a fusing unit that fuses the toner image on the surface of the transfer material;

a cleaning unit that removes a toner or dust attached to the electrostatic latent image holding member; and a discharging unit that discharges the electrostatic latent image remaining on the electrostatic latent image holding member, wherein the transfer unit comprises an intermediate transfer member using a semiconductive belt comprising an electroconductive resin composition containing an epoxidized diene block copolymer, a thermoplastic elastomer other than the epoxidized diene block copolymer and a conductive agent.

22. An image forming apparatus comprising:

an electrostatic latent image holding member on which an electrostatic latent image is formed;

a charging unit that uniformly charges the surface of the electrostatic latent image holding member;

an exposure unit that exposes the surface of the electrostatic latent image holding member;

a developing unit that that develops the electrostatic latent image by using a developer for electrostatic charge image to form a toner image;

a transfer unit that transfers the toner image onto the surface of the transfer material;

a fusing unit that fuses the toner image on the surface of the transfer material;

a cleaning unit that removes a toner or dust attached to the electrostatic latent image holding member; and a discharging unit that discharges the electrostatic latent image remaining on the electrostatic latent image holding member, wherein the charging unit comprises an electroconductive roll comprising an electroconductive resin composition containing an epoxidized diene block copolymer, a thermoplastic elastomer other than the epoxidized diene block copolymer and a conductive agent.

23. An image forming apparatus comprising:

an electrostatic latent image holding member on which an electrostatic latent image is formed;

a charging unit that uniformly charges the surface of the electrostatic latent image holding member;

an exposure unit that exposes the surface of the electrostatic latent image holding member;

a developing unit that that develops the electrostatic latent image by using a developer for electrostatic charge image to form a toner image;

a transfer unit that transfers the toner image onto the surface of the transfer material;

a fusing unit that fuses the toner image on the surface of the transfer material;

a cleaning unit that removes a toner or dust attached to the electrostatic latent image holding member; and a discharging unit that discharges the electrostatic latent image remaining on the electrostatic latent image holding member, wherein the transfer unit comprises an electroconductive roll comprising an electroconductive resin composition containing an epoxidized diene block copolymer, a thermoplastic elastomer other than the epoxidized diene block copolymer and a conductive agent.

* * * * *